US006267735B1

(12) United States Patent
Blanchard et al.

(10) Patent No.: US 6,267,735 B1
(45) Date of Patent: Jul. 31, 2001

(54) CONTINUOUS PASSIVE MOTION DEVICE HAVING A COMFORT ZONE FEATURE

(75) Inventors: Frederick W. Blanchard, Portage, MI (US); Stephen L. Brown, Chattanooga, TN (US); Dwayne Hofstatter, Woodstock, GA (US); D. Chris Linville, Hixson, TN (US); Jeffrey K. Pohl, Chattanooga, TN (US); James R. Vetter, Jr., Soddy Daisy, TN (US)

(73) Assignee: Chattanooga Group, Inc., Hixson, TN (US)

( * ) Notice: Subject to any disclaimer, the term of this patent is extended or adjusted under 35 U.S.C. 154(b) by 0 days.

(21) Appl. No.: 09/437,173

(22) Filed: Nov. 9, 1999

(51) Int. Cl.[7] ..... A61H 1/02
(52) U.S. Cl. ..... 601/33; 601/23; 601/34
(58) Field of Search ..... 601/23–35; 606/240–244

(56) References Cited

U.S. PATENT DOCUMENTS

| | | | | |
|---|---|---|---|---|
| 4,487,199 | | 12/1984 | Saringer . | |
| 4,492,222 | | 1/1985 | Hajianpour . | |
| 4,520,827 | | 6/1985 | Wright et al. . | |
| 4,549,534 | | 10/1985 | Zagorski et al. . | |
| 4,558,692 | | 12/1985 | Greiner . | |
| 4,566,440 | | 1/1986 | Berner et al. . | |
| 4,602,618 | | 7/1986 | Berze . | |
| 4,603,687 | | 8/1986 | Greenwood . | |
| 4,621,620 | * | 11/1986 | Anderson | 601/34 |
| 4,637,379 | | 1/1987 | Saringer . | |
| 4,665,899 | | 5/1987 | Farris et al. . | |
| 4,671,257 | | 6/1987 | Kaiser et al. . | |
| 4,798,197 | | 1/1989 | Nippoldt et al. . | |
| 4,807,601 | | 2/1989 | Wright . | |
| 4,825,852 | | 5/1989 | Genovese et al. . | |
| 4,834,073 | | 5/1989 | Bledsoe et al. . | |
| 4,930,497 | | 6/1990 | Saringer . | |
| 5,228,432 | | 7/1993 | Kaiser et al. . | |
| 5,239,987 | | 8/1993 | Kaiser et al. . | |
| 5,252,102 | | 10/1993 | Singer et al. . | |
| 5,255,188 | | 10/1993 | Telepko . | |
| 5,273,520 | * | 12/1993 | Rebmann | 601/34 |
| 5,277,681 | * | 1/1994 | Holt | 482/112 |
| 5,280,783 | | 1/1994 | Focht et al. . | |
| 5,303,716 | | 4/1994 | Mason et al. . | |
| 5,399,147 | | 3/1995 | Kaiser . | |
| 5,452,205 | | 9/1995 | Telepko . | |
| 5,509,894 | | 4/1996 | Mason et al. . | |
| 5,682,327 | | 10/1997 | Telepko . | |

OTHER PUBLICATIONS

Advertisement for BREG FLEX–MATE K500, 1997.

* cited by examiner

*Primary Examiner*—Justine R. Yu
(74) *Attorney, Agent, or Firm*—Chambliss, Bahner & Stophel, P.C.

(57) ABSTRACT

A therapeutic device may be used in providing physical therapy for a patient's knee by moving the patient's leg through a plurality of cycles of motion in each of a number of treatment sessions. The device includes a "Comfort Zone" range of motion feature which allows an operator to temporarily increase the flexion angle (or decrease the extension angle) to alleviate discomfort the patient is experiencing as the upper leg support and lower leg support pivot or attempt to pivot through a portion of the operational range of motion. The preferred embodiment of the device will automatically decrease the flexion angle (or automatically increase the extension angle) at a predetermined rate over a period of treatment time, so that the device may return to operation between the preset operational limits of the range of motion with a lower chance that the patient will experience the same pain or discomfort which necessitated the establishment of a Comfort Zone limit. In a preferred embodiment of the invention, the carriage holding the patient's leg is decelerated, at a controlled rate over a controlled distance, from the operational speed to zero, as the carriage approaches the extension or flexion limit, and the carriage is accelerated in the same fashion as the carriage moves away from the extension or flexion limit.

24 Claims, 5 Drawing Sheets

CONTINUOUS PASSIVE MOTION DEVICE HAVING A COMFORT ZONE FEATURE

FIELD OF THE INVENTION

The present invention relates generally to medical rehabilitation devices, and more particularly to a device which may be used to flex the knee joint of a patient as part of a therapeutic or rehabilitative program.

BACKGROUND OF THE INVENTION

Knee injuries are an unfortunate byproduct of today's emphasis on sports and physical fitness; however, effective surgical techniques have been developed to repair injuries such as to the anterior cruciate ligament (ACL) and other components of the knee. In addition, many members of our aging population are candidates for total knee replacement surgery because of disease and/or injury. All of these surgical procedures must be followed by a period of rehabilitation in order for recovery to be complete. Furthermore, some injuries to the knee may not require surgery but instead may require an extensive rehabilitation period. Such rehabilitation generally requires that the knee be flexed and the leg be extended such as occurs in normal walking; however, it is frequently undesirable for a recovering patient to bear weight on his leg while rehabilitating his knee. In addition, when a knee has suffered a trauma or other injury, or after surgery, a person often lacks the necessary muscle control, strength or will to flex his knee and straighten his leg. Consequently, there is a need for a rehabilitation device that can be used to mobilize the joint over a period of time as a part of the orthopedic care which follows an injury, illness or surgical procedure.

The therapeutic use of an external force to flex and extend the limb to induce motion is referred to as passive motion. The application of continuous passive motion to a joint following a period of immobilization, injury, surgery or the like, has been shown to reduce post-operative pain, decrease the number of adhesions, decrease the amount of atrophy experienced by the surrounding and supporting muscle, promote the speed of recovery, improve the range of motion in a much shorter time, and reduce the risk of deep vein thrombosis and post-traumatic osteopenia. Depending on the nature and severity of the knee injury or the nature and extent of the surgical procedure performed, therapeutic treatment sessions involving continuous passive motion may be carried out on a daily basis for several days or several weeks.

The concept of a therapeutic use of passive and continuous motion is not new, as evidenced by a number of known devices that are designed to impose continuous passive motion on the limb and joint of a patient for such purpose. For example, U.S. Pat. No. 4,492,222 of Hajianpour describes a knee exerciser comprised of a leg support that is hinged at one end to a thigh support and is fixed at its other end to a motor assembly. The other end of the thigh support is pivotally attached to a frame, and the motor assembly is also pivotally attached to the frame. A screw that is threaded into a tubular portion of the leg support is rotated by the motor to drive the device. The Hajianpour device also includes an up/down counter that is arranged to count revolutions of the motor drive shaft via a magnetic sensor. When the count of the counter reaches either the flexion or extension limits, the direction of rotation of the motor is changed.

U.S. Pat. No. 4,558,692 of Greiner describes a motor driven leg exerciser having an adjustable leg support, a movable footrest, a motor, and controls for the user or therapist. In operation, the motor drives a chain driven rod back and forth in an arc to move the leg support. As the rod reaches each end of its arc, it activates a directional switch which in turn stops the motor, causes the device to pause for a predetermined period of time, and reverses the direction of the rod. The arcuate movement of the rod causes the leg support to move the patient's leg from an extended position to a bent position.

As the use of therapeutic continuous passive motion (CPM) machines has increased, so too have the number of developments and improvements in the related technology. For example, U.S. Pat. No. 4,798,197 of Nippoldt et al. and U.S. Pat. No. 4,558,692 of Greiner describe various safety features which, upon the occurrence of any of several conditions, will cause the carriage holding the leg to stop and reverse direction. The Nippoldt device includes a remote controller by means of which a patient can cause the carriage to start moving in one direction, to stop, and to move in the other direction through successive actuations of a START/STOP switch mounted on a pendent. The Greiner device is equipped with a patient control box that allows the patient to temporarily stop the motion of the carriage, reverse direction and then start the motion again, or to turn the machine off. In addition, if the carriage of the Greiner device moves the leg into a position where resistance is encountered, an override switch will automatically stop and reverse the motor to prevent injury or discomfort to the patient.

U.S. Pat. No. 4,825,852 of Genovese et al. describes hinges between the upper and lower members of the leg support which are designed to better mimic the motion of the knee joint and thereby increase patient comfort; U.S. Pat. Nos. 5,255,188 and 5,452,205, both of Telepko, describe a universal controller for a CPM device which includes a clock and a liquid crystal display for displaying the accumulated running time for an exercise session; U.S. Pat. No. 5,682,327 of Telepko describes a direct drive CPM device which maintains an approximately constant angular velocity at the knee so as to increase the comfort level of the patient; and U.S. Pat. No. 4,665,899 of Farris et al. describes a CPM device having control means which allows the user or a therapist to change the degree of extension and flexion of the leg, and also having a repetition counter that can count and display the number of flexion repetitions completed. Furthermore, U.S. Pat. No. 4,566,440 of Bemer, et al. and U.S. Pat. No. 5,682,327 of Telepko describe continuous passive motion devices which pivot the patient's leg about a virtual axis that is coincident with the hip pivot axis. This helps to avoid placing unnecessary strain on the patient's leg or hip joint, and increases the comfort of the patient as treatment is carried out.

U.S. Pat. Nos. 5,452,205 and 5,682,327, both of Telepko, describe a dynamic tension mode of treatment in which a continuous constant force is applied to the joint under treatment for a predetermined period of time in order to extend the range of motion of the joint. The constant force is applied in one direction for a predetermined period of time or until a predetermined limit is reached. A constant force is then applied in the opposite direction. This sequence of motion and tensioning is designed to minimize patient fatigue. U.S. Pat. No. 5,252,102 of Singer et al. describes an electronic range of motion apparatus which is adaptable for use with a prosthesis or a CPM machine and which gradually increases the patient's flexion and extension ability with gentle stretching utilizing a self-programmable feature and multiple range options. Finally, U.S. Pat. No. 5,682,852 of Telepko describes a "warm-up" mode of operation by which the range of motion of the device is automatically and gradually increased over a preset period of time at the beginning of a treatment session. U.S. Pat. No. 4,825,852 of Genovese et al. describes a similar "warm-up" feature by which the programmed force and range of motion is automatically reduced somewhat when exercise is restarted after a rest period.

Despite these improvements in CPM technology, conventional CPM devices suffer from several disadvantages. Among these is the fact that conventional CPM machines do not generally provide a mechanism for relieving or avoiding pain or sensitivity that a patient may experience when his knee is being flexed or his leg extended in a direction or to a point or angle which is uncomfortable. While some CPM machines automatically turn themselves off when a preset level of resistance is encountered during operation, many CPM machines are not sensitive or responsive to resistance encountered during operation and continue flexion and extension to the preset limits until turned off. Although a few CPM machines stop and/or reverse the direction of the driver and carriage when signaled by the patient or when a preset level of resistance is encountered, those same machines attempt to return the carriage to the preset flexion or extension limit on the next cycle, thereby, subjecting the patient to a risk that he will encounter the same discomfort or perhaps injury. It would be desirable, therefore, if a continuous passive motion device could be developed that would stop and reverse the direction of its carriage when the patient experiences discomfort and that would subsequently establish a Comfort Zone or reduced range of motion for a number of cycles. It would also be desirable if this reduced range of motion could be automatically increased or expanded over a number of cycles until flexion and/or extension may be carried out at the point at which discomfort was experienced. It would also be desirable if such a device could be developed that would be relatively simple for a patient to operate and therefore, more likely to be properly used.

Another disadvantage of the constant speed CPM machines is that the carriage holding the patient's leg is rapidly decelerated from the operational speed of the carriage to zero as the carriage reaches its operational extension or flexion limit, and rapidly accelerated from zero to the operational speed in the opposite direction as the carriage moves away from the limit. Such sudden speed and direction changes are uncomfortable for the patient and may impose undesirable stresses on his knee and leg. It would be desirable therefore, if a CPM device could be developed which would allow the carriage to make "Soft Turns" when changing directions.

ADVANTAGES OF THE INVENTION

Accordingly, the invention described and claimed herein provides a continuous passive motion device that may be programmed to stop and reverse the direction of its carriage when a patient actuates a "Comfort Zone" feature upon experiencing discomfort during flexion or extension. The device may be programmed to establish a reduced range of motion or Comfort Zone for a number of cycles of flexion and extension, after which the range of motion will preferably be gradually and automatically increased or advanced until flexion and/or extension may be carried out at the point at which discomfort was experienced. The preferred embodiment of the invention thus provides the patient with immediate relief from discomfort while allowing flexion and extension to continue automatically and in a controlled manner until flexion and/or extension may be carried out at the point at which discomfort was experienced. In this way, the preferred embodiment of the invention provides a CPM device which may be operated so as to decrease the likelihood that the patient will experience similar discomfort when the carriage returns to the point along the axis of the frame at which discomfort was initially experienced (and at which the Comfort Zone feature was actuated). Another advantage of a preferred embodiment of the invention is its "Soft Turns" capability, wherein the carriage holding the patient's leg is decelerated, at a controlled rate over a controlled distance, from the operational speed to zero, as the carriage approaches the extension or flexion limit, and wherein the carriage is accelerated in the same fashion as the carriage moves away from the extension or flexion limit.

Other advantages and features of this invention will become apparent from an examination of the drawings and the ensuing description.

EXPLANATION OF TECHNICAL TERMS

As used herein, the term range of motion refers to a range of angular motion between the lower leg support and the upper leg support of the invention. The term range of motion may also refer to the range of angular motion that is or may be imposed on a patient's knee by the invention, as measured by the change in the angle between the tibia and the femur of the patient's leg.

As used herein, the term flexion refers to that portion of a range of motion in which the angle between the lower leg support and the upper leg support of the invention, or the angle between the tibia and the femur of the patient's leg, is decreasing.

As used herein, the term flexion phase refers to that portion or phase of the operation of the invention during which flexion occurs.

As used herein, the term extension refers to that portion of a range of motion in which the angle between the lower leg support and the upper leg support of the invention, or the angle between the tibia and the femur of the patient's leg, is increasing.

As used herein, the term extension phase refers to that portion or phase of the operation of the invention during which extension occurs.

As used herein, the term flexion limit refers to a limit that may be imposed during flexion on the angle between the lower leg support and the upper leg support of the invention, or on the angle between the tibia and the femur of the patient's leg. The term flexion limit also refers to a point along the axis of the frame of a preferred embodiment of the invention to which, but not beyond which, the driver may be moved by operation of the motor during a flexion phase. When the driver reaches the flexion limit, the direction of motion of the driver along the axis of the frame will change and extension will begin.

As used herein, the term extension limit refers to a limit to extension that may be imposed on the angle between the lower leg support and the upper leg support of the invention, or on the angle between the tibia and the femur of the patient's leg. The term extension limit also refers to a point along the axis of the frame of a preferred embodiment of the invention to which, but not beyond which, the driver may be moved by operation of the motor during an extension phase. When the driver reaches an extension limit, the direction of motion of the driver along the axis of the frame will change and flexion will begin. An extension limit of greater than 180° may be referred to as hyperextension.

As used herein, the term limit may refer to either an extension limit or a flexion limit, depending on the context.

As used herein, the term flexion angle refers to the angle between the lower leg support and the upper leg support of the invention at a point during a flexion phase or at a particular flexion limit.

As used herein, the term extension angle refers to the angle between the lower leg support and the upper leg support of the invention at a point during an extension phase or at a particular extension limit.

As used herein, the term cycle refers to a continuous operation of the invention either from a flexion limit to an extension limit and back to a flexion limit, or from an extension limit to a flexion limit and back to an extension limit. The term cycle also refers to the movement of a patient's leg through a single flexion phase and a single extension phase.

As used herein, the term sub-cycle refers to a continuous operation of the invention from a flexion limit to a Comfort Zone limit or an intermediate extension limit and back to a flexion limit or from an extension limit to a Comfort Zone limit or an intermediate flexion limit and back to an extension limit.

As used herein, the term treatment time refers to the time during which the invention is operated continuously to move the patient's leg through a plurality of cycles, even though such operation may include one or more pauses in the motion imparted to the patient's leg.

As used herein, the term treatment session refers to a use of the invention for a treatment time.

As used herein, the term operational flexion limit refers to a flexion limit that is established for a selected range of motion. The operational flexion limit may be changed during a treatment session.

As used herein, the term operational extension limit refers to an extension limit that is established for a selected range of motion. The operational extension limit may be changed during a treatment session.

As used herein, the terms speed or rate of operation refer to the rate of change of the angle between the upper leg support and the lower leg support, as such supports pivot at the connection therebetween, per unit of time. As used herein in connection with the preferred embodiment, the terms speed or rate of operation may also refer to the rate at which the driver moves along the axis of the frame per unit of time, although such rate is typically expressed in terms of the rate of change of the angle between the upper leg support and the lower leg support.

SUMMARY OF THE INVENTION

The invention comprises a therapeutic device for use in providing physical therapy for a patient's knee by moving the patient's leg through a plurality of cycles of motion in a treatment session. The device includes a "Comfort Zone" range of motion feature by which the patient or another operator may set a Comfort Zone limit to the range of motion to alleviate discomfort suffered by the patient during flexion or extension. This Comfort Zone limit may correspond to a flexion angle that is greater than the operational flexion angle (if set during a flexion phase), or to an extension angle that is less than the operational extension angle (if set during an extension phase). In a preferred embodiment of the invention, the carriage holding the patient's leg is decelerated, at a controlled rate over a controlled distance, from the operational speed to zero, as the carriage approaches the extension or flexion limit, and the carriage is accelerated in the same fashion as the carriage moves away from the extension or flexion limit.

The therapeutic device includes an elongated frame having an axis, a lower leg support which is adapted to support the lower leg of the patient, and an upper leg support which is adapted to support the upper leg of the patient. Each of the lower leg support and the upper leg support has a first end and a second end, and the first end of the upper leg support is pivotally connected to the first end of the lower leg support. The frame, lower leg support and upper leg support are interconnected in a manner such that both the tibia and the femur of the patient are generally coplanar with the axis of the frame. The device also includes means for repeatedly pivoting the lower leg support and the upper leg support at the connection therebetween so as to move the patient's leg through a plurality of cycles of motion, each of which imposes a range of motion on the patient's leg comprising a flexion phase, in which the angle between the lower leg support and the upper leg support is decreasing, and an extension phase, in which the angle between the lower leg support and the upper leg support is increasing. The device also includes means for setting a desired range of motion including an operational extension limit and an operational flexion limit. The operational extension limit corresponds to an operational extension angle between the upper leg support and the lower leg support to which the upper and lower leg supports may be pivoted during the extension phase of a cycle, and the operational flexion limit corresponds to an operational flexion angle between the upper leg support and the lower leg support to which the upper and lower leg supports may be pivoted during the flexion phase of a cycle. The device also includes means for setting a Comfort Zone limit to the range of motion. The Comfort Zone limit corresponds to a Comfort Zone angle between the upper leg support and the lower leg support, and may be set as a flexion limit or an extension limit. If set as a flexion limit, the Comfort Zone limit will correspond to a Comfort Zone flexion angle that is greater than the operational flexion angle. If set as an extension limit, the Comfort Zone limit will correspond to a Comfort Zone extension angle that is less than the operational extension angle. The device also includes means for setting at least one intermediate limit to the range of motion. Each intermediate limit corresponds to an intermediate angle between the upper leg support and the lower leg support, and each such intermediate limit may be set as an intermediate flexion limit, if the Comfort Zone limit has been set as a flexion limit, or as an intermediate extension limit, if the Comfort Zone limit has been set as an extension limit. Each intermediate flexion limit that is set will correspond to an intermediate flexion angle between the upper leg support and the lower leg support that is less than the Comfort Zone flexion angle and greater than the operational flexion angle, and if more than one intermediate flexion limit is set, each such limit after the first in a sequence of such limits will correspond to a flexion angle that is less than the flexion angle which corresponds to the previous flexion limit in the sequence. Each such intermediate extension limit that is set will correspond to an intermediate extension angle between the upper leg support and the lower leg support that is greater than the Comfort Zone extension angle and less than the operational extension angle, and if more than one intermediate extension limit is set, each such limit after the first in a sequence of such limits will correspond to an extension angle that is greater than the extension angle which corresponds to the previous extension limit in the sequence. The device also includes means for moving the flexion limit, if the Comfort Zone limit is set as a flexion limit, sequentially from the operational flexion limit to the Comfort Zone flexion limit, and then to each intermediate flexion limit, in turn, wherein each successive intermediate flexion limit is nearer to the operational flexion limit than the next preceding intermediate flexion limit, and then to the operational flexion limit. The device also includes means for moving the extension limit, if the Comfort Zone limit is set as a extension limit, sequentially from the operational extension limit to the Comfort Zone extension limit, and then to each intermediate extension limit, in turn, wherein each successive intermediate extension limit is nearer to the operational extension limit than the next preceding intermediate extension limit, and then to the operational extension limit. The device also includes means for counting the number of times that the upper leg support and the lower leg support are pivoted from the operational extension limit to the Comfort Zone flexion limit, if the Comfort Zone limit is set as a flexion limit, or the number of times that the upper leg support and the lower leg support are pivoted from operational flexion limit to the Comfort Zone extension limit, if the Comfort Zone limit is set as an extension limit. The device also includes means for setting a number of times that the upper leg support and the lower leg support may be pivoted from the operational extension angle to the Comfort Zone limit, if the Comfort Zone limit was set as an flexion limit, or for setting a number of times that the upper leg support and the lower leg support may be pivoted from the operational flexion limit to the Comfort Zone limit, if the Comfort Zone limit was set as an extension limit.

Furthermore, the invention provides a method for providing physical therapy for a patient's knee by moving the patient's leg through a plurality of cycles of motion in a treatment session during which the patient may experience discomfort or pain in a manner so that the pain or discomfort may be minimized while treatment continues.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to those skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
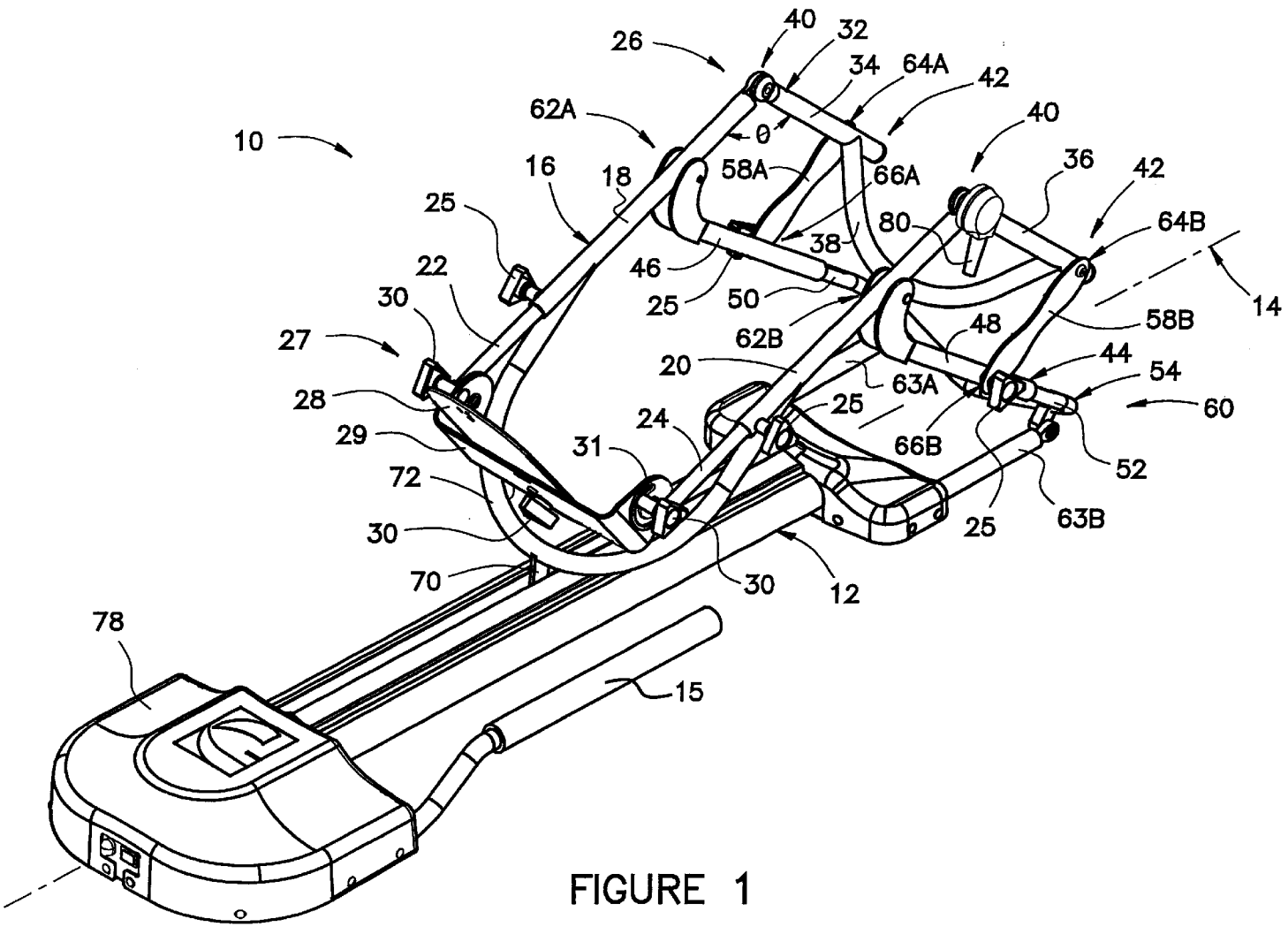
FIG. 1 is a front perspective view of the preferred embodiment of the therapeutic device.

Referring now to the drawings, preferred therapeutic device 10 operates by application of continuous passive motion to the knee joint of a patient during a treatment session that includes flexion of the knee and extension of the leg. Such motion is considered to be continuous or substantially continuous even though there will or may be pauses or stops at the flexion and extension limits, and perhaps at other times. Device 10 may be utilized in providing a regimen of physical therapy for a patient's knee by moving the patient's leg through a plurality of cycles of motion in each of a number of treatment sessions.

Figure 2:
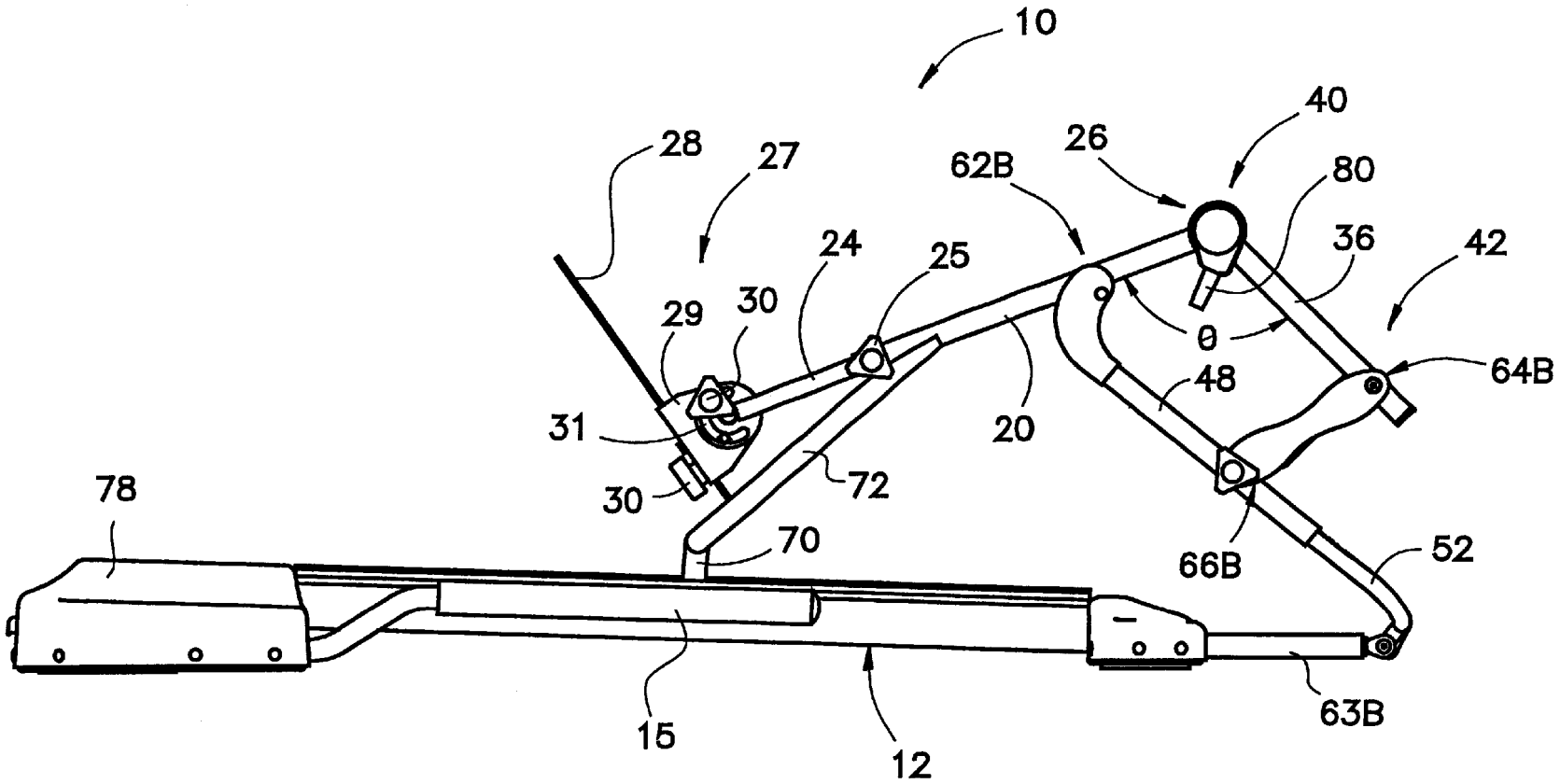
FIG. 2 is a side view of the device of FIG. 1.
Figure 3:
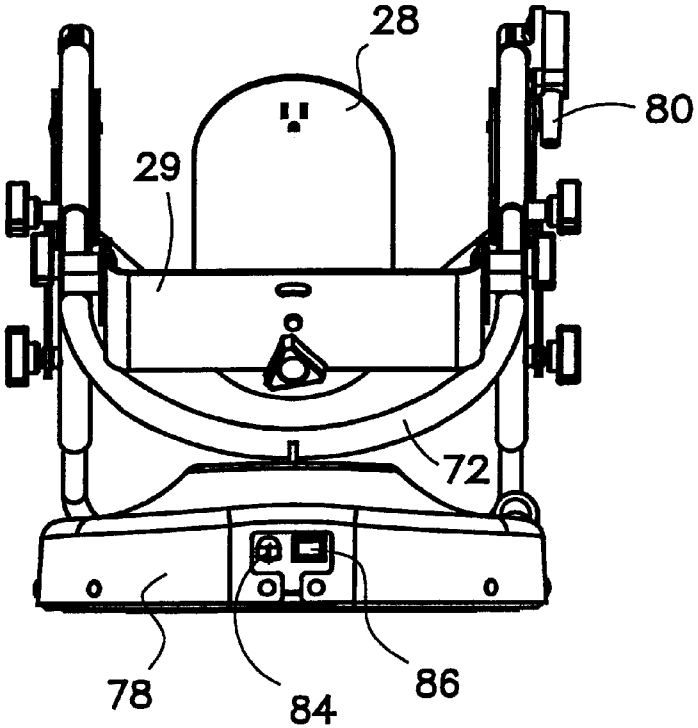
FIG. 3 is a front elevation view of the device of FIG. 1.

Referring now to FIGS. 1 through 4, therapeutic device 10 includes elongated frame 12 having an axis 14 along its length. Preferably, the frame also includes carrying handle 15 which is located and balanced to provide easy portability of the machine. Device 10 also includes lower leg support 16 which is adapted to support the lower leg of the patient. Lower leg support 16 is preferably comprised of a pair of parallel tubular components 18 and 20 to which are attached a pair of telescoping end tubes 22 and 24, respectively. Each of the end tubes is adapted for sliding motion within the tubular component with which it is associated so as to permit adjustment of the length of the lower leg support to accommodate the lower leg length of the patient. Each of tubular components 18 and 20 is provided with a hole (not shown) through which a length adjusting bolt 25 may be placed in threaded engagement therewith. The adjusting bolt may then be advanced in the hole to bear against the surface of the end tube, and thereby to hold it securely in place. In the alternative, a length adjusting bolt 25 may be provided to engage with one of a series of holes (not shown) that are provided along the length of each of end tubes 22 and 24. By selecting the appropriate holes along the length of the end tubes for attachment to the tubular components, the length of the lower leg support may be adjusted. Lower leg support 16 has a first end designated generally at 26 near the knee of the patient and a second end designated generally at 27 adjacent to the patient's foot. Preferably, foot support 28 is mounted to the lower leg support through pivotally attached end plate 29. As shown in FIGS. 1 through 3, the foot support is attached to the end plate by means of bolt 30. The end plate is provided with an arc-shaped bolt hole 31 at each end into which a pair of bolts 30, fixed to the ends of tubes 22 and 24, may be placed for pivotal attachment to the lower leg support.

Device 10 also includes an upper leg support 32 which is adapted to support the upper leg of the patient. Upper leg support 32 of preferred device 10 includes an upper portion comprised of a pair of parallel tubular components 34 and 36 and a connecting cross support member 38. The upper leg support has a first end designated generally at 40 near the knee of the patient and a second end designated generally at 42 adjacent to the patient's hip. First end 40 of upper leg support 32 is pivotally connected to first end 26 of lower leg support 16.

The upper leg support of preferred therapeutic device 10 also includes U-shaped third support 44, which is comprised of a pair of parallel tubular components 46 and 48 to which are attached a pair of telescoping end tubes 50 and 52, respectively, of U-shaped end portion 54. Each of the end tubes is adapted for sliding motion within the tubular component with which it is associated so as to permit adjustment of the length of the upper leg support to accommodate the upper leg length of the patient. Each of tubular components 46 and 48 is provided with a hole (not shown) through which a length adjusting bolt 25 may be placed in threaded engagement therewith. The adjusting bolt may then be advanced in the hole to bear against the surface of the end tube, and thereby to hold it securely in place. In the alternative, a length adjusting bolt 25 may be provided to engage with one of a series of holes (not shown) that are provided along the length of each of end tubes 50 and 52. By selecting the appropriate holes along the length of the end tubes for attachment to the tubular components, the length of the upper leg support may be adjusted to accommodate the upper leg length of the patient. Scales 56A and 56B (see FIG. 4) are provided for convenience in adjusting the length of the upper leg support. The scales correspond to upper leg lengths for patients of different sizes. A patient's upper leg, from his hip to his knee, may be measured and components 50 and 52 slid into components 46 and 48 respectively until the ends of components 50 and 52 reach the patient's measured length on scales 56A and 56B. The third support has a first end 60 and a second end 62. First end 60 is pivotally attached to extensions 63A and 63B of frame 12, and second end 62 is pivotally attached to lower leg support 16 (second end 62A is attached to tubular component 18 and second end 62B is attached to tubular component 20).

Preferred upper leg support 32 also includes a pair of linkage members 58A and 58B (sometimes referred to herein collectively as linkage). The linkage members also have a first end 64 and a second end 66. First end 64A of linkage member 58A is pivotally attached to tubular component 34 of upper leg support 32 at or near second end 42, and second end 66A of linkage member 58A is pivotally attached to tubular component 46 of third support 44 (by means of a bolt 25) at a point intermediate between first end 60 and second end 62. Similarly, first end 64B of linkage member 58B is pivotally attached to tubular component 34 of upper leg support 32 at or near second end 42, and second end 66B of linkage member 58B is pivotally attached (by means of a bolt 25) to tubular component 48 of third support 44 at a point intermediate between first end 60 and second end 62.

Figure 4:
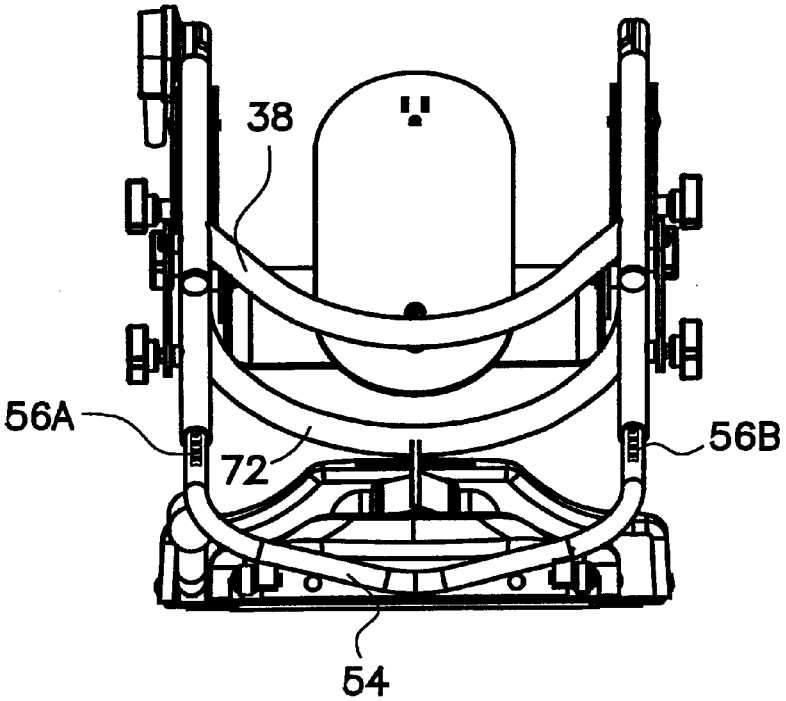
FIG. 4 is a rear elevation view of the device of FIG. 1.
Figure 5:
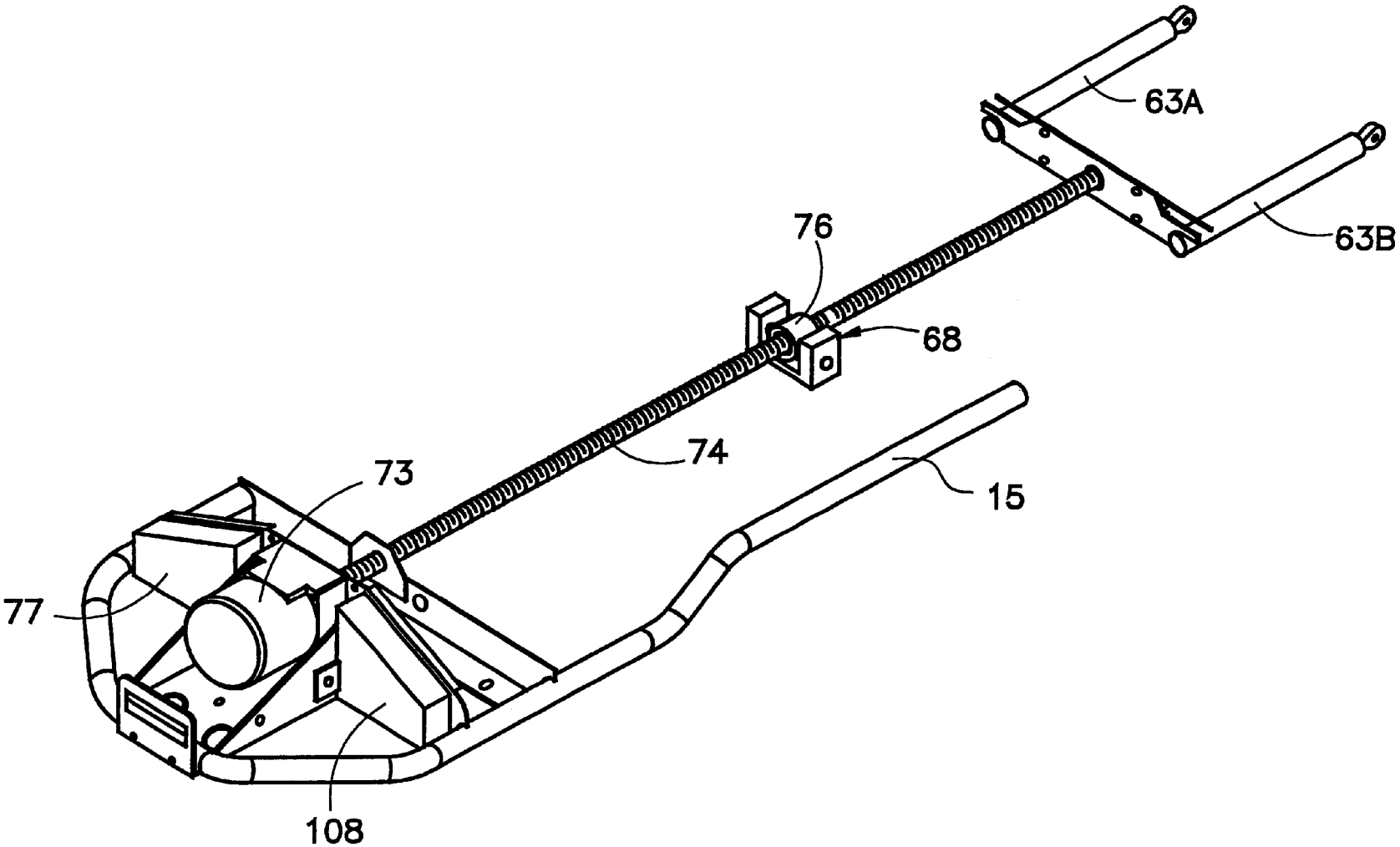
FIG. 5 is a partial front perspective view of the preferred embodiment of the invention, similar to FIG. 1 but showing details of the drive mechanism of the invention.

As has been mentioned, first end 26 of lower leg support 16 is pivotally attached to first end 40 of upper leg support 32. Device 10 is adapted to repeatedly pivot the lower leg support and the upper leg support at this connection so as to move the patient's leg through a plurality of cycles of motion, each of which imposes a range of motion on the patient's leg comprising a flexion phase in which the angle $\theta$ (see FIGS. 1 and 2) between the lower leg support and the upper leg support is decreasing, and an extension phase in which the angle $\theta$ between the lower leg support and the upper leg support is increasing. The pivotal motion of the upper and lower leg supports is preferably obtained by the movement of driver 68 (see FIG. 5), which is attached to the second end of lower leg support 16 through upright attachment 70 and U-shaped tubular stabilizer 72. Preferably, the tubular stabilizer component of the lower leg support is welded to tubular components 18 and 20 and to upright attachment 70. The driver is adapted to move in both directions along the axis 14 of the frame by operation of motor 73 (see FIG. 5). Preferably, the motor is adapted to turn externally threaded drive rod 74 which is mounted in the frame and disposed along the axis of the frame, and driver 68 includes an internally threaded nut 76 that is adapted to mate with the drive rod. As shown in FIG. 4, nut 76 is mounted on the drive rod in threaded engagement therewith, so that the driver may be moved along the axis of the frame as the drive rod is turned by the motor.

In an alternative embodiment (not shown), the drive means of the invention may include a pulley and a cord mounted thereon, which cord is adapted to be moved along the axis of the frame by operation of the motor. In such embodiment, the driver is attached to the cord and is adapted to move along the axis of the frame as the cord is moved by operation of the motor. Still another embodiment (also not shown) of the drive means may be provided by a piston which is mounted in the frame and disposed along the axis thereof. In this embodiment, the piston has a piston rod that is adapted to be moved along the axis of the frame by operation of a pump, and the driver is attached to the piston rod and is adapted to move along the axis of the frame as the piston is operated by the pump.

By lying on his back at the rear of device 10 (to the right in FIGS. 1 and 2), a patient may place his leg in the device in proper supporting manner so that his upper leg is supported by support 32 and his lower leg is supported by support 16, with his knee located generally at the junction of first end 40 of upper leg support and first end 26 of lower leg support. As is apparent from an examination of the drawings, the frame, lower leg support and upper leg support are interconnected in a manner such that both the tibia (of the lower leg) and the femur (of the upper leg) of the patient are generally coplanar with the axis of the frame. Furthermore, because of the connection of the lower leg support to the driver, as illustrated in the drawings, movement of the driver in one direction along the axis will cause extension and movement of the driver in the opposite direction along the axis will cause flexion.

The invention includes a computer controller 77 such as is known generally to those having ordinary skill in the art to which the invention relates. This controller is mounted within housing 78, and wiring (not shown) is provided from the controller through the frame and through the various tubular components to control jack 80 (see FIG. 1). A control pendant 82 (see FIG. 6) is provided with a control cord (not shown) that is adapted to be plugged into the control jack to permit a therapist and/or the patient to access the controller. The combination of controller 77 and control pendant 82, connected through the control cord of the pendant and jack 80, provides means for controlling the various functions of the invention.

The invention thus includes control means for setting a desired range of motion including an operational extension limit and an operational flexion limit. The operational extension limit corresponds to an operational extension angle $\theta_{oe}$ between the upper leg support and the lower leg support to which the upper and lower leg supports may be pivoted during the extension phase of a cycle. In the embodiment of the invention that is illustrated in the drawings, the operational extension limit also corresponds to a point along the axis of the frame to which the driver may be moved during the extension phase by operation of the motor to establish an operational extension angle $\theta_{oe}$. The operational flexion limit corresponds to an operational flexion angle $\theta_{of}$ between the upper leg support and the lower leg support to which the upper and lower leg supports may be pivoted during the flexion phase of a cycle. In the embodiment of the invention that is illustrated in the drawings, the operational flexion limit also corresponds to a point along the axis of the frame to which the driver may be moved by operation of the motor during the flexion phase to establish an operational flexion angle $\theta_{of}$. Furthermore, the control means for setting a desired range of motion in the illustrated embodiment includes limit switches or other means to insure that when the driver is moved by the operation of the motor to an extension limit, it will reverse direction and move towards the flexion limit. Similarly, when the driver is moved to a flexion limit, it will reverse direction and move towards the extension limit.

The upper leg support and the lower leg support may be referred to as the carriage, and the pivoting movement of the upper leg support and the lower leg support during a flexion phase may be referred to as moving the carriage towards the flexion limit. Similarly the pivoting movement of the upper leg support and the lower leg support during an extension phase may be referred to as moving the carriage towards the extension limit.

The invention permits the patient or a therapist to establish a "Comfort Zone" if the patient experiences pain or discomfort, which will change the range of motion through which the patient's knee is flexed and his leg extended so that additional pain and discomfort may be avoided while the treatment session continues. When this Comfort Zone is established according to the invention, the range of motion through which the upper leg support and lower leg support may pivot is temporarily reduced.

Consequently, the invention includes control means (comprised of the combination of controller 77 and control pendant 82) for setting a Comfort Zone limit to the range of motion. The Comfort Zone limit corresponds to a Comfort Zone angle $\theta_{cz}$ between the upper leg support and the lower leg support, which angle will correspond, in the illustrated embodiment, to a point along the axis of the frame to which the driver may be moved by operation of the motor. The Comfort Zone limit may be set as a flexion limit or an extension limit. Preferably, the invention includes a Comfort Zone actuator by which the patient may set the Comfort Zone limit as a flexion limit during a flexion phase or as an extension limit during an extension phase. It is also preferred that the control means for setting a Comfort Zone limit set such limit upon actuation of the actuator by the patient. In such event, the patient may set the Comfort Zone limit at a time in the treatment session, and at a flexion or extension angle, of his choosing.

If the Comfort Zone limit is set as a flexion limit, the Comfort Zone limit will correspond to a Comfort Zone flexion angle $\theta_{czf}$ that is greater than the operational flexion angle $\theta_{of}$. Preferably, in such event, the Comfort Zone flexion angle will be about 5° greater than the flexion angle between the upper leg support and the lower leg support at the time the patient engages or actuates the Comfort Zone actuator. If the Comfort Zone limit is set as an extension limit, the Comfort Zone limit will correspond to a Comfort Zone extension angle $\theta_{cze}$ that is less than the operational extension angle $\theta_{of}$, and preferably about 5° less than the extension angle between the upper leg support and the lower leg support at the time the patient actuates the Comfort Zone actuator.

The device also includes means (comprised of the combination of controller 77 and control pendant 82) for counting the number of times that the upper leg support and the lower leg support are pivoted (or in the preferred embodiment of the invention, the number of times the driver moves) from the operational extension limit to the Comfort Zone limit, if the Comfort Zone limit is set as a flexion limit, and the number of times that the upper leg support and the lower leg support are pivoted (or in the preferred embodiment of the invention, the number of times the driver moves) from the operational flexion limit to the Comfort Zone limit, if the Comfort Zone limit is set as an extension limit. The device also includes means (comprised of the combination of controller 77 and control pendant 82) for setting a number of times that the upper leg support and the lower leg support may be pivoted (or in the preferred embodiment of the invention, the number of times the driver may move) from the operational extension limit to the Comfort Zone limit, if the Comfort Zone limit is set as an flexion limit, and for setting a number of times that the upper leg support and the lower leg support may be pivoted (or the number of times the driver may move) from the operational flexion limit to the Comfort Zone limit, if the Comfort Zone limit is set as an extension limit. In both such instances, it is preferred that the set number of times that the upper leg support and the lower leg support are pivoted (or the number of times the driver moves) from the operational limit to the Comfort Zone limit is five.

The invention also includes control means (comprised of the combination of controller 77 and control pendant 82) for setting at least one intermediate limit to the range of motion. Each such intermediate limit will correspond to an intermediate angle $\theta_i$ between the upper leg support and the lower leg support, which angle will correspond, in the illustrated embodiment, to a point along the axis of the frame to which the driver may be moved by operation of the motor. Each such intermediate limit may be set as an intermediate flexion limit or an intermediate extension limit.

If the Comfort Zone limit is set as a flexion limit, the intermediate limit or limits will be set as flexion limits, each of which will correspond to an intermediate flexion angle $\theta_{if}$ between the upper leg support and the lower leg support that is less than the Comfort Zone flexion angle $\theta_{czf}$ and greater than the operational flexion angle $\theta_{of}$. If more than one intermediate flexion limit is set, each such limit after the first in a sequence of such limits will correspond to a flexion angle that is less than the flexion angle which corresponds to the previous flexion limit in the sequence.

If the Comfort Zone limit is set as a flexion limit, it is preferred that the intermediate flexion limit nearest to the Comfort Zone limit will correspond to an intermediate angle between the upper leg support and the lower leg support that is 1° less than the Comfort Zone flexion angle. It is also preferred in such circumstance, that if more than one intermediate limit is set, each intermediate flexion limit after the first in the sequence corresponds to an intermediate angle between the upper leg support and the lower leg support that is 1° less than the flexion angle which corresponds to the previous intermediate flexion limit in the sequence. Furthermore, it is also preferred that the last intermediate limit in the sequence will correspond to an intermediate angle that is equal to the flexion angle between the upper leg support and the lower leg support at the point where the Comfort Zone feature was actuated.

If the Comfort Zone limit is set as an extension limit, the intermediate limits will be set as extension limits, each of which will correspond to an intermediate extension angle $\theta_{ie}$ between the upper leg support and the lower leg support that is greater than the Comfort Zone extension angle $\theta_{cze}$ and less than the operational extension angle $\theta_{oe}$. If more than one intermediate extension limit is set, each such limit after the first in a sequence of such limits will correspond to an extension angle that is greater than the extension angle which corresponds to the previous extension limit in the sequence. If the Comfort Zone limit is set as an extension limit, it is preferred that the intermediate extension limit nearest to the Comfort Zone limit corresponds to an intermediate angle between the upper leg support and the lower leg support that is 1° greater than the Comfort Zone angle. It is also preferred, if the Comfort Zone limit is set as an extension limit and if more than one intermediate limit is set, that each intermediate extension limit after the first in the sequence corresponds to an intermediate angle between the upper leg support and the lower leg support that is 1° greater than the extension angle which corresponds to the previous intermediate extension limit in the sequence. Furthermore, it is also preferred that the last intermediate limit in the sequence will correspond to an intermediate angle that is equal to the extension angle between the upper leg support and the lower leg support at the point where the Comfort Zone feature was actuated.

The invention also includes control means (comprised of the combination of controller 77 and control pendant 82) for moving the flexion limit, if the Comfort Zone limit is set as a flexion limit, sequentially from the operational flexion limit to the Comfort Zone limit and then to each intermediate flexion limit, in turn, wherein each successive intermediate flexion limit is nearer to the operational flexion limit than the next preceding intermediate flexion limit, and then to the operational flexion limit. It is preferred that if the Comfort Zone limit is set as a flexion limit, the flexion limit will be moved to the intermediate flexion limit corresponding to an intermediate flexion angle nearest to the Comfort Zone angle, after the upper leg support and the lower leg support have been pivoted from the operational extension limit to the Comfort Zone limit the set number of times.

A preferred embodiment of the invention includes control means (comprised of the combination of controller 77 and control pendant 82) for counting and setting the number of times that the upper leg support and the lower leg support are pivoted (or the number of times the driver is moved) from the operational extension limit to each intermediate flexion limit, if the comfort zone limit is set as a flexion limit. In this embodiment of the invention, the flexion limit will be moved from the intermediate flexion limit nearest to the Comfort Zone limit to the next successive intermediate flexion limit after the set number of times the upper leg support and the lower leg support are pivoted from the operational extension limit to the intermediate flexion limit. Furthermore, the number of times the upper leg support and the lower leg support are pivoted from the operational extension limit to each intermediate flexion limit, before the flexion limit is moved to the next successive intermediate flexion limit, may be set independently of the number of times the upper leg support and the lower leg support are pivoted from the operational extension limit to each other intermediate flexion limit.

Control means (comprised of the combination of controller 77 and control pendant 82) are also provided for moving the extension limit, if the Comfort Zone limit is set as an extension limit, sequentially from the operational extension limit to the Comfort Zone limit and then to each intermediate extension limit, in turn, wherein each successive intermediate extension limit is nearer to the operational extension limit than the next preceding intermediate extension limit, and then to the operational extension limit. If the Comfort Zone limit is set as an extension limit, after the set number of times the upper leg support and the lower leg support are pivoted from the operational flexion limit to the Comfort Zone limit, the extension limit will be moved to the intermediate extension limit corresponding to an intermediate extension angle nearest to the Comfort Zone angle.

A preferred embodiment of the invention includes control means (comprised of the combination of controller 77 and control pendant 82) for counting and setting the number of times that the upper leg support and the lower leg support are pivoted (or the number of times that the driver is moved) from the operational flexion limit to each intermediate extension limit, if the Comfort Zone limit is set as an extension limit. In this embodiment of the invention, the extension limit will be moved from the intermediate extension limit nearest to the Comfort Zone limit to the next successive intermediate extension limit after the set number of times the upper leg support and the lower leg support are pivoted from the operational flexion limit to the intermediate flexion limit. Furthermore, the number of times the upper leg support and the lower leg support are pivoted from the operational flexion limit to each intermediate extension limit, before the extension limit is moved to the next successive intermediate extension limit, may be set independently of the number of times the upper leg support and the lower leg support are pivoted from the operational flexion limit to each other intermediate extension limit.

Figure 6:
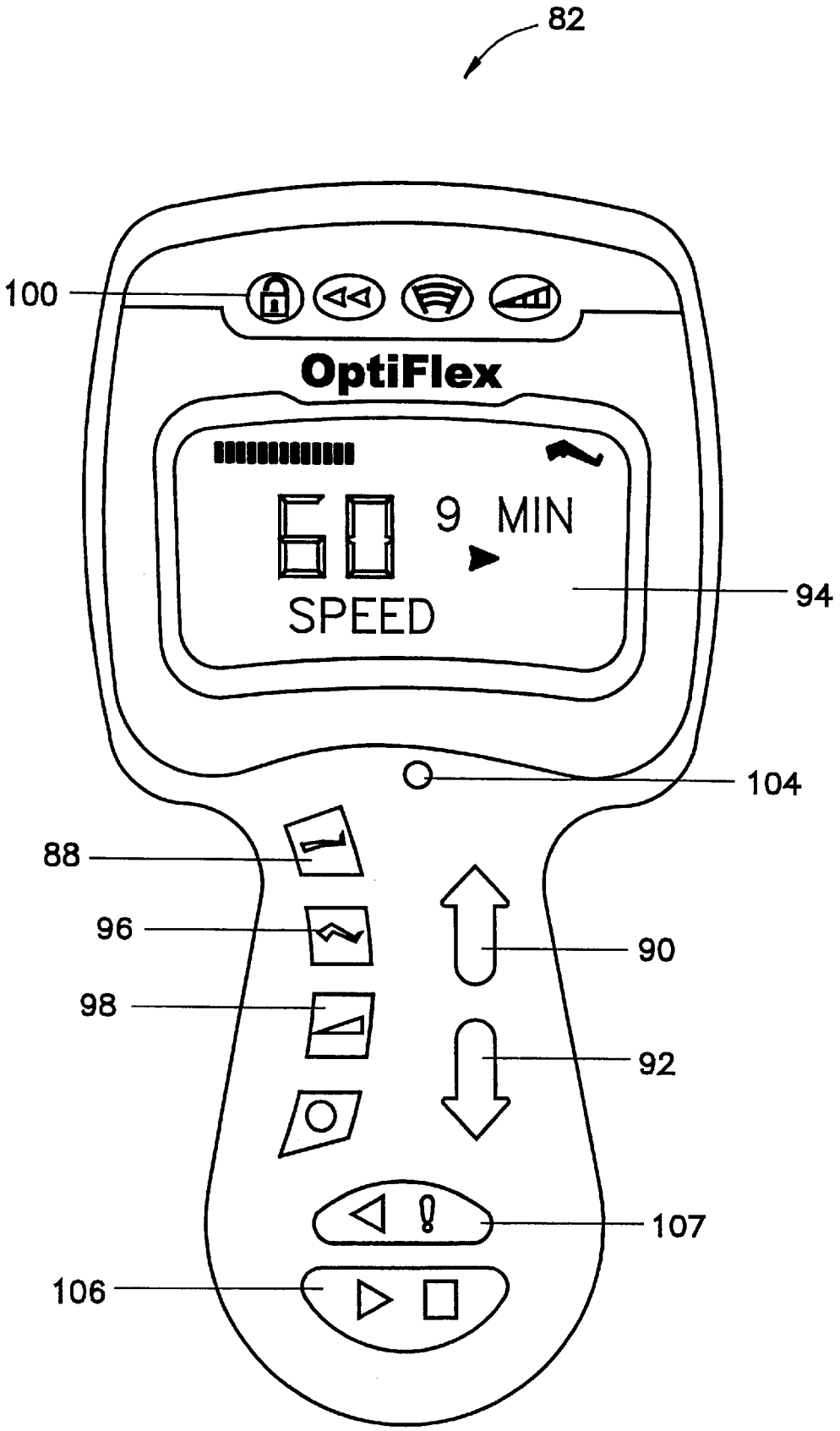
FIG. 6 is a front view of a control pendent that may be used in connection with the preferred embodiment of the invention.

In order to begin treatment using device 10, a power cord (not shown) is attached at power receptacle 84 (see FIG. 3) and connected to a common 110V electrical power circuit. On/Off switch 86 may then be then activated to energize the machine. Referring now to FIG. 6, the patient may set the extension limit of the operational range of motion by pressing Extension button 88 while pressing the Up button 90 or the Down button 92. Once the Extension button is pressed, the currently programmed extension limit (expressed as an extension angle) will appear on LCD display 94, along with an appropriate notation such as "Extension Angle". The display will also show the changes in the extension angle while both the Extension button 88 and either the Up or Down buttons are pressed. Once the desired extension limit for the operational range of motion is set, the operational flexion limit and the rates or speeds of pivoting operation may be set by the same method using the Flexion button 96 along with the Up and Down buttons, and the Speed button 98 and the Up and Down buttons.

The preferred embodiment of the invention contemplates that the Comfort Zone limit will be set by the patient's actuating the Comfort Zone feature of the invention when he experiences discomfort or pain during flexion or extension. It is also preferred that the Comfort Zone limit be set at a point that corresponds to an angle between the upper leg support and the lower leg support that is 5° greater than the flexion angle between the upper leg support and the lower leg support at the point where the Comfort Zone feature is actuated, if the Comfort Zone limit is set during a flexion phase (or at a point that corresponds to an angle that is 5° less than the extension angle between the upper leg support and the lower leg support at the point where the Comfort Zone feature is actuated, if the Comfort Zone limit is set during an extension phase). However, Comfort Zone variation angles other than 5° (as measured from the point at which the Comfort Zone feature is actuated) are also contemplated. One embodiment of the invention may provide that the Comfort Zone variation angle be set by use of the Comfort Zone button 107 and the Up and Down buttons on control pendent 82. It is preferred that the 5° variation be set as the default value if no other variation angle is set.

It is also preferred that a plurality of intermediate limits be set corresponding to angles between the upper leg support and the lower leg support. Preferably, the intermediate limit nearest to the Comfort Zone limit corresponds to an intermediate angle that is 1° less than the Comfort Zone limit, if the Comfort Zone limit is set as a flexion limit (or 1° greater than the Comfort Zone limit, if the Comfort Zone limit is set as a extension limit). It is also preferred that each intermediate limit after the first in the sequence varies from the previous intermediate limit by 1°. Finally, it is preferred that the last intermediate limit in the sequence corresponds to an intermediate angle between the upper leg support and the lower leg support that is equal to the angle between the upper leg support and the lower leg support at the point where the Comfort Zone feature is actuated. Thus, if the Comfort Zone variation angle is set at 5°, it is preferred that five intermediate limits be set between the Comfort Zone limit and the point where the Comfort Zone feature was actuated (with the last such intermediate limit in the sequence corresponding to an angle between the upper leg support and the lower leg support that is equal to that at the point where the Comfort Zone feature was actuated), and that each such limit corresponds to an intermediate angle that varies by 1° from the previous intermediate angle in the sequence. However, angular variations between the intermediate angles of other than 1° are also contemplated by the invention.

A preferred embodiment of the invention may provide that after the Comfort Zone variation angle is set (by use of the Comfort Zone button 107 and the Up and Down buttons), pushing the Comfort Zone button a second time will permit the operator to set (using the Up and Down buttons) the number of intermediate limits, and pushing the Comfort Zone button a third time will permit the operator to set (using the Up and Down buttons) the angular variation between the intermediate angles (each of which corresponds to an intermediate limit). It is preferred that the 1° angular variation between the intermediate angles be set as the default value if no other variation is set, and that the last intermediate limit in the sequence correspond to an angle between the upper leg support and the lower leg support that is equal to that at which the Comfort Zone feature is actuated.

Once the operational limits, a first rate of pivoting operation, a Comfort Zone variation angle, an intermediate angular variation and a number of intermediate limits have been set, device 10 may be set into motion by pressing Start/Stop button 106. The motor will drive the driver along the axis of the frame, back and forth in a substantially continuous fashion, so as to move the patient's leg through a plurality of cycles of motion, each of which imposes a range of motion on the patient's leg comprising a flexion phase and an extension phase. The direction of the movement of the driver along the axis of the frame will reverse when the driver reaches a flexion limit or an extension limit. Preferably, the device will accommodate a flexion limit corresponding to a flexion angle $\theta_f$ of about 60° or greater, and an extension limit corresponding to an extension angle $\theta_e$ of about 190° or less. The invention also contemplates that display 94 may express any of the flexion and/or extension angles referred to herein as 180°−θ. In other words, a flexion angle $\theta_f$ of 60° may be expressed as 120° (180°−60°), and an extension angle $\theta_e$ of 190° may be expressed as −10° (180°−190°).

In the preferred embodiment of the invention, the means (comprised of the combination of controller 77 and control pendant 82) for setting the Comfort Zone limit and the intermediate limits may be configured so as to set such limits only as flexion limits, consistent with the most common treatment regimen that is prescribed for knee rehabilitation. For other treatment regimens, however, it may be appropriate to configure the machine to set such limits only as extension limits. Furthermore, it is within the scope of the invention to provide means for setting a Comfort Zone and intermediate flexion limits, as well as a Comfort Zone and intermediate extension limits.

Once device 10 has been put into operation, the driver will move along the axis of the frame between the programmed operational extension limit and the programmed operational flexion limit. However, if the patient experiences discomfort as his knee is flexed or his leg extended through one or more portions of the operational range of motion, he may actuate the Comfort Zone feature by pressing Comfort Zone button 107 on control pendant 82. When the Comfort Zone feature is actuated, a Comfort Zone limit will be set at a point along the axis and the LCD display 94 will display an alphanumeric message such as "Comfort Zone Activated". If the driver is moving along the axis in the flexion phase when the Comfort Zone feature is actuated, the Comfort Zone limit will be set as a flexion limit and will preferably correspond to a flexion angle that is 5° greater than the flexion angle between the upper leg support and the lower leg support defined by the location of the driver along the axis at point where the Comfort Zone button was pressed. Similarly, if the driver is moving along the axis in the extension phase when the Comfort Zone feature is actuated, the Comfort Zone limit will be an extension limit and will preferably correspond to an extension angle that is 5° less than extension angle between the upper leg support and the lower leg support defined by the location of the driver along the axis at point where the Comfort Zone button was pressed. It is also preferred that when the Comfort Zone feature is actuated, the driver will immediately stop and reverse its direction along the axis of the frame.

At least one intermediate limit will be set upon actuation of the Comfort Zone feature. In the preferred embodiment of the invention, a plurality of such limits will be set, each of which will correspond to an intermediate angle between the upper leg support and the lower leg support. If the driver was moving in the flexion phase at the time the Comfort Zone feature was actuated, each such intermediate limit will be set as a flexion limit. If the driver was moving in the extension phase at the time the Comfort Zone feature was actuated, each such intermediate limit will be set as an extension limit. Preferably, the intermediate limit nearest to the Comfort Zone limit corresponds to an intermediate angle that is 1° less than the Comfort Zone angle, if the Comfort Zone limit is set as a flexion limit (or 1° greater than the Comfort Zone angle, if the Comfort Zone limit is set as a extension limit). It is also preferred that each intermediate limit after the first in the sequence corresponds to an intermediate angle that varies from the previous intermediate angle by 1°. Finally, it is preferred that the last intermediate limit in the sequence corresponds to an intermediate angle between the upper leg support and the lower leg support that is equal to the angle between the upper leg support and the lower leg support upon actuation of the comfort zone actuator. Thus, if the Comfort Zone variation angle is set at 5°, it is preferred that five intermediate limits be set between the Comfort Zone limit and the point where the Comfort Zone feature was actuated (with the last intermediate limit corresponding to an intermediate angle between the upper leg support and the lower leg support that is equal to that at the point where the Comfort Zone feature was actuated), and that each such limit corresponds to an intermediate angle that varies by 1° from the angle of the previous limit in the sequence.

Once the Comfort Zone feature is actuated, the Comfort Zone limit will be set and the driver will preferably immediately reverse direction and begin to move to the operational limit. If the Comfort Zone feature was actuated during the flexion phase, the driver will immediately stop its motion towards the operational flexion limit, reverse direction and move to the operational extension limit. Upon reaching the operational extension limit, the driver will again reverse direction and move towards the operational flexion limit. However, when it reaches the Comfort Zone limit, it will stop its motion towards the operational flexion limit, reverse direction and move to the operational extension limit. When the driver moves from the operational extension limit to the Comfort Zone flexion limit (or pivots the upper and lower leg supports from the operational extension angle to the Comfort Zone flexion angle), the means (comprised of the combination of controller 77 and control pendant 82) for counting the number of times such motion occurs increases the count by one. This sub-cycle of motion will be carried out the set number of times, and then the flexion limit will be moved from the Comfort Zone limit to the intermediate flexion limit corresponding to the intermediate flexion angle (or, if more than one intermediate flexion limit has been set, to the intermediate flexion limit corresponding to the intermediate flexion angle nearest to the Comfort Zone angle). Then the driver will sub-cycle between the operational extension limit and the intermediate flexion limit. In a preferred embodiment of the invention, this sub-cycle of motion will be carried out a set number of times, and then the flexion limit will be moved. If more than one flexion limit has been set, the flexion limit will be moved sequentially to each intermediate flexion limit, in turn, wherein each successive intermediate limit is nearer to the operational flexion limit than the next preceding intermediate flexion limit. Once each intermediate flexion limit is established, in turn, the driver will sub-cycle between the operational extension limit and the intermediate flexion limit.

In one embodiment of the invention, a set number of times, other than one, may be selected for sub-cycling the driver between the operational extension limit and each intermediate limit. In such embodiment, each time the driver moves from the operational extension limit to an intermediate flexion limit (or pivots the upper and lower leg supports from the operational extension angle to an intermediate flexion angle), the means for counting the number of times such motion occurs increases the count by one, until the set number of times is reached. It is preferred, however, that the driver sub-cycle between the operational extension limit and each intermediate limit only one time, if the intermediate flexion limits are set so as to correspond to intermediate flexion angles separated by 1°. Once the driver has moved from the operational extension limit to an intermediate flexion limit the set number of times (preferably one), the flexion limit will move to the next intermediate flexion limit which is nearer the operational flexion limit, or if no intermediate flexion limit is nearer the operational flexion limit, then to the operational flexion limit. Of course, the means (comprised of the combination of controller 77 and control pendant 82) for setting and counting the number of times the driver moves between the operational extension limit and each intermediate flexion limit may focus on the number of times the driver moves from the intermediate flexion limit to the operational extension limit (instead of on the number of times it moves from the operational extension limit to the intermediate flexion limit), or on the number of times the driver reverses direction at a limit, and all such means are within the scope of the invention. As described herein, it is preferred that the driver move five consecutive times from the operational extension limit to the Comfort Zone flexion limit and then back to the operational extension limit, and then that it move one time from the operational extension limit to each intermediate flexion limit and back to the operational extension limit, in turn. Such motion will temporarily reduce the range of motion through which the driver operates, so as to reduce any pain or discomfort the patient is experiencing in his knee or leg, and will then gradually and automatically increase the range of motion over a period of time back to the point at which the Comfort Zone feature was actuated. This method of treatment will permit the patient relief from pain and will reduce the likelihood that the patient will experience the same pain or discomfort when flexion and/or extension is carried out at the same level which necessitated the actuation of a Comfort Zone limit.

Of course, the invention may also be employed to set a Comfort Zone limit during extension, in which case the Comfort Zone limit will be set as an extension limit. In such event, the driver will sub-cycle between the operational flexion limit and the Comfort Zone extension limit in a manner similar to that described above for the set number of times, and then it will sub-cycle between the operational flexion limit and the intermediate extension limit. If more than one intermediate limit is set, the driver will sub-cycle the set number of times between the operational flexion limit and the Comfort Zone limit, and then it will sub-cycle between the operational flexion limit and each successive intermediate extension limit, in turn, also as described above. If more than one intermediate limit is set, the first such intermediate extension limit will be nearest to the Comfort Zone limit and each successive intermediate extension limit will be nearer to the operational extension limit than the next preceding intermediate extension limit in the sequence.

As an example of operation of the Comfort Zone feature according to the preferred embodiment of the invention, an operational flexion limit may be set corresponding to a flexion angle of 80° and an operational extension limit may be set corresponding to an extension angle of 170°. A Comfort Zone variation angle may be set at 5° and an intermediate angular variation may be set at 1°. Five may be set as the number of intermediate limits (or the last limit may be set to correspond to an angle between the upper leg support and the lower leg support that is equal to that at which the Comfort Zone feature is actuated). Five may also be set as the number of times that the driver will sub-cycle between the operational extension limit and the Comfort Zone limit, and one may be set as the number of times that the driver will sub-cycle between the operational extension limit and each intermediate limit. If during operation of the therapeutic device, the Comfort Zone is activated in the flexion phase when the driver is located at a point along the axis which corresponds to a flexion angle (between the upper leg support and the lower leg support) of 85°, a Comfort Zone flexion limit will then be set at a point along the axis to which the driver may be moved to establish a flexion angle of 90°. Five intermediate flexion limits will also be set, the intermediate flexion limits each corresponding to an angle which is greater than operational flexion angle (80°) and less than the Comfort Zone flexion angle (90°). Each intermediate limit set will correspond to an angle that is about 1° less than the angle corresponding to the adjacent limit in the sequence, so that intermediate limits corresponding to flexion angles of 89°, 88°, 87°, 86° and 85° are set.

Upon actuation of the Comfort Zone feature, the driver will reverse direction and move to the operational extension limit. After reversing direction at the operational extension limit, the driver will move to the Comfort Zone flexion limit corresponding to an angle of 90° and back to the operational extension limit. The driver will move in this fashion between the operational extension limit and the Comfort Zone flexion limit five times. Then the flexion limit will be moved to the intermediate flexion limit which is nearest the Comfort Zone flexion limit (89°). The driver will move from the operational extension limit to the first intermediate flexion limit corresponding to a flexion angle of 89°. When the driver reaches the first intermediate flexion limit, it will reverse direction and move to the operational extension limit. The flexion limit will then be moved to the adjacent intermediate flexion limit which is nearer the operational flexion limit (corresponding to a flexion angle of 88°). The driver will move from the operational extension limit to the second intermediate flexion limit at 88°. When the driver reaches the second intermediate flexion limit, it will reverse direction and move to the operational extension limit. The flexion limit will then be moved to the adjacent intermediate flexion limit which is nearer the operational flexion limit (corresponding to a flexion angle of 87°). The driver will then move from the operational extension limit to the third intermediate flexion limit at 87°. When the driver reaches the third intermediate flexion limit, it will reverse direction and move to the operational extension limit. The flexion limit will then be moved to the adjacent intermediate flexion limit which is nearer the operational flexion limit (corresponding to a flexion angle of 86°). The driver will then move from the operational extension limit to the fourth intermediate flexion limit at 86°. When the driver reaches the fourth intermediate flexion limit, it will reverse direction and move to the operational extension limit. The flexion limit will then be moved to the adjacent intermediate flexion limit which is nearer the operational flexion limit (corresponding to a flexion angle of 85°). The driver will then move from the operational extension limit to the fifth flexion limit at 85°. When the driver reaches the fifth flexion limit, it will reverse direction and move to the operational extension limit. The flexion limit will then be moved to the operational flexion limit, and the driver will cycle between the operational extension limit and the operational flexion limit. The machine will continuing operating between the operational limits until the Comfort Zone feature is actuated again. The patient or therapist may activate the Comfort Zone feature as many times as desired, and at any point in the flexion phase or extension phase (other than at, or within the variation angle of, the operational limits).

The preferred embodiment of the invention also contemplates a "Soft Turns" feature by which sudden changes in speed and direction at the flexion and extension limits are avoided. According to this embodiment of the invention, control means (comprised of the combination of controller 77 and control pendant 82) are provided for decelerating the driver from the preset speed of motion at a predetermined rate as it approaches an extension limit (where the driver stops and changes direction) beginning at a predetermined distance along the axis from the extension limit. Control means (comprised of the combination of controller 77 and control pendant 82) are also provided for accelerating the driver from a stop at an extension limit to the preset speed of motion at a predetermined rate for a predetermined distance after the driver reverses direction upon reaching the extension limit. In addition, this embodiment of the invention includes control means (comprised of the combination of controller 77 and control pendant 82) for decelerating the driver from the preset speed of motion at a predetermined rate as it approaches a flexion limit (where the driver stops and changes direction) beginning at a predetermined distance along the axis from the flexion limit and control means (comprised of the combination of controller 77 and control pendant 82) for accelerating the driver from a stop at a flexion limit to the preset speed of motion at a predetermined rate for a predetermined distance after the driver reverses direction upon reaching the flexion limit. Preferably, the predetermined distance along the axis at which deceleration of the driver as it approaches an extension limit begins defines a point along the axis of the frame that establishes an angle between the upper leg support and the lower leg support that is approximately 1–2° less than the extension angle for such cycle or sub-cycle. Furthermore, it is also preferred that the predetermined distance along the axis during which the driver is accelerated after it reverses direction upon reaching an extension limit defines a point along the axis of the frame that establishes an angle between the upper leg support and the lower leg support that is approximately 1–2° less than the extension angle for such cycle, and the predetermined distance along the axis at which deceleration of the driver as it approaches a flexion limit begins defines a point along the axis of the frame that establishes an angle between the upper leg support and the lower leg support that is approximately 1–2° greater than the flexion angle for such cycle. Furthermore, it is also preferred that the predetermined distance along the axis during which the driver is accelerated after it reverses direction upon reaching a flexion limit defines a point along the axis of the frame that establishes an angle between the upper leg support and the lower leg support that is approximately 1–2° greater than the flexion angle for such cycle. Finally, it is also preferred that the rate of deceleration and acceleration be constant.

As an example of operation of the "Soft Turns" and Comfort Zone features according to the preferred embodiment of the invention, an operational flexion limit may be set corresponding to a flexion angle of 80° and an operational extension limit may be set corresponding to an extension angle of 170°. A first rate or speed of operation of the driver may be set at 60° per minute, and the points at which acceleration and deceleration begin and end may be set corresponding to angles between the upper and lower leg supports of 82° and 168°. A Comfort Zone variation angle may be set at 5° and an intermediate angular variation may be set at 1°. Five may be set as the number of intermediate limits (or the last limit may be set to correspond to an angle between the upper leg support and the lower leg support that is equal to that at which the Comfort Zone feature is actuated). Five may also be set as the number of times that the driver will sub-cycle between the operational extension limit and the Comfort Zone limit, and one may be set as the number of times that the driver will sub-cycle between the operational extension limit and each intermediate limit.

When the driver is set in motion, it will move along the axis of the machine during the flexion phase at a rate of 60° per minute until it reaches a point corresponding to a flexion angle of 82°. At this point, the driver will decelerate from a speed of 60° per minute to zero at the flexion limit. Then it will accelerate as it moves from the flexion limit in the opposite direction. This acceleration will continue until the driver reaches a point corresponding to an extension angle of 82°, at which point the driver will be moving at the preset speed of 60° per minute. It will maintain this speed until it reaches a point corresponding to an extension angle of 168°. At this point, the driver will decelerate from a speed of 60° per minute to zero at the extension limit. Then it will change directions and accelerate as it moves from the extension limit. This acceleration will continue until the driver reaches a point corresponding to a flexion angle of 168°, at which point the driver will be moving at the preset speed of 60° per minute. The device will continue to operate in this manner until the Comfort Zone button is pressed. Assuming the Comfort Zone button was pressed while the driver was moving in the flexion phase at a point along the axis which corresponds to a flexion angle of 85°, as provided in the first example above, the device will establish a Comfort Zone flexion limit corresponding to a flexion angle of 90° and intermediate flexion limits corresponding to angles of 89°, 88°, 87°, 86° and 85°. While the Soft Turns feature will not operate any differently in concept while the device operates in the Comfort Zone, the points at which the driver begins and ends its acceleration and deceleration at the flexion limit will be moved to 92°, 91°, 90°, 89°, 88° and 87°, respectively, as the flexion limit is moved to the Comfort Zone limit (90°), the first intermediate limit (89°), the second intermediate limit (88°), the third intermediate limit (87°), the fourth intermediate limit (86°) and the fifth intermediate limit (85°). Each time the flexion limit is moved, so too is the point at which the Soft Turns acceleration and deceleration begins and ends.

The therapeutic device may also include a storage means 108 capable of storing data about one or more different patients including the extension and flexion limits used during a treatment session for each of the patients. The invention may also include a retrieval means by which the data in the storage means can be accessed at a later time.

Once the control and data storage features of the invention are appreciated, the controller 77 and data storage means 108 required for operating device 10 may be programmed by those having ordinary skill in the art to which the invention relates.

As can be seen from the description herein, the invention provides a therapeutic device designed to aid in the rehabilitation of a patient's knee, wherein the device which may be programmed in such a manner that when the Comfort Zone feature is actuated, the device will reduce the range of motion experienced by the patient. Another advantage of a preferred embodiment of the invention is its "Soft Turns" capability, wherein the carriage holding the patient's leg is decelerated, at a controlled rate over a controlled distance, from the preset operational speed to zero, as the carriage approaches the extension or flexion limit, and wherein the carriage is accelerated in the same fashion as the carriage moves away from the extension or flexion limit.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A therapeutic device for use in providing physical therapy for a patient's knee, which device comprises:

(a) an elongated frame having an axis;

(b) a lower leg support having a first end and a second end and being adapted to support the lower leg of the patient;

(c) an upper leg support having a first end and a second end and being adapted to support the upper leg of the patient;

wherein the first end of the upper leg support is pivotally connected to the first end of the lower leg support so that said upper leg support and said lower leg support are pivoted with respect to each other through a plurality of pivotal positions, each of which establishes an angle between said upper leg support and said lower leg support; and wherein said frame, lower leg support and upper leg support are interconnected in a manner such that both the tibia and the femur of the patient are generally coplanar with the axis of the frame; said therapeutic device further including:

(d) means for repeatedly pivoting the lower leg support and the upper leg support at the connection therebetween so as to move the patient's leg through a plurality of cycles of motion, each of which:

(1) imposes a range of motion on the patient's leg comprising a flexion phase, in which the angles of the pivotal positions between the lower leg support and the upper leg support are decreasing, and an extension phase, in which the angles of the pivotal positions between the lower leg support and the upper leg support are increasing;

(2) is defined by a flexion limit which establishes the minimum angle between the lower leg support and the upper leg support to which the lower leg support and the upper leg support are pivoted during a flexion phase and an extension limit which establishes the maximum angle between the lower leg support and the upper leg support to which the lower leg support and the upper leg support are pivoted during an extension phase;

(e) means for setting a desired range of motion including:

(1) an operational extension limit which corresponds to an operational extension angle between the upper leg support and the lower leg support to which the upper and lower leg supports are pivoted during the extension phase of a cycle; and (2) an operational flexion limit which corresponds to an operational flexion angle between the upper leg support and the lower leg support to which the upper and lower leg supports are pivoted during the flexion phase of a cycle;

(f) means for setting a comfort zone limit within the desired range of motion, which comfort zone limit corresponds to a comfort zone angle between the upper leg support and the lower leg support, wherein said comfort zone limit is set:

(1) as a flexion limit which will correspond to a comfort zone flexion angle that is greater than the operational flexion angle; or (2) as an extension limit which will correspond to a comfort zone extension angle that is less than the operational extension angle;

(g) means for setting at least one intermediate limit within the desired range of motion, wherein each such intermediate limit corresponds to an intermediate angle between the upper leg support and the lower leg support, and wherein each such intermediate limit is set:

(1) as a flexion limit, if the comfort zone limit is set as a flexion limit, so that each intermediate limit will correspond to an intermediate flexion angle between the upper leg support and the lower leg support that is less than the comfort zone flexion angle and greater than the operational flexion angle, and so that if more than one intermediate flexion limit is set, each such limit after the first in a sequence of such limits will correspond to a flexion angle that is less than the flexion angle which corresponds to the previous flexion limit in the sequence; or (2) as an extension limit, if the comfort zone limit is set as an extension limit, so that each intermediate limit will correspond to an intermediate extension angle between the upper leg support and the lower leg support that is greater than the comfort zone extension angle and less than the operational extension angle, and so that if more than one intermediate extension limit is set, each such limit after the first in a sequence of such limits will correspond to an extension angle that is greater than the extension angle which corresponds to the previous extension limit in the sequence;

(h) means for moving:

(1) the flexion limit, if the comfort zone limit is set as a flexion limit, sequentially from the operational flexion limit to the comfort zone limit, and then to each intermediate flexion limit, in turn, wherein each successive intermediate limit is nearer to the operational flexion limit than the next preceding intermediate flexion limit, and then to the operational flexion limit;

(2) the extension limit, if the comfort zone limit is set as an extension limit, sequentially from the operational extension limit to the comfort zone limit, and then to each intermediate extension limit, in turn, wherein each successive intermediate extension limit is nearer to the operational extension limit than the next preceding intermediate extension limit, and then to the operational extension limit;

(i) means for counting:

(1) the number of times the upper leg support and the lower leg support are pivoted from the operational extension limit to the comfort zone limit, if the comfort zone limit is set as a flexion limit;

(2) the number of times the upper leg support and the lower leg support are pivoted from the operational flexion limit to the comfort zone limit, if the comfort zone limit is set as an extension limit;

(j) means for setting:

(1) the number of times the upper leg support and the lower leg support are pivoted from the operational extension limit to the comfort zone limit, if the comfort zone limit is set as a flexion limit;

(2) the number of times the upper leg support and the lower leg support are pivoted from the operational flexion limit to the comfort zone limit, if the comfort zone limit is set as an extension limit.

2. The device of claim 1 wherein the length of the lower leg support is adjustable.

3. The device of claim 1 wherein:

(a) five is set as the number of times the upper leg support and the lower leg support are pivoted from the operational extension limit to the comfort zone limit, if the comfort zone limit is set as a flexion limit; or (b) five is set as the number of times the upper leg support and the lower leg support are pivoted from the operational flexion limit to the comfort zone limit, if the comfort zone limit is set as an extension limit.

4. The device of claim 1 wherein:

(a) after the set number of times the upper leg support and the lower leg support are pivoted from the operational extension limit to the comfort zone limit, if the comfort zone limit is set as a flexion limit, the flexion limit is moved to the intermediate flexion limit corresponding to an intermediate flexion angle nearest to the comfort zone angle;

(b) after the set number of times the upper leg support and the lower leg support are pivoted from the operational flexion limit to the comfort zone limit, if the comfort zone limit is set as an extension limit, the extension limit is moved to the intermediate extension limit corresponding to an intermediate extension angle nearest to the comfort zone angle.

5. The device of claim 1 wherein:

(a) the intermediate flexion limit nearest to the comfort zone limit corresponds to an intermediate angle between the upper leg support and the lower leg support that is 1° less than the comfort zone flexion angle, if the comfort zone limit is set as a flexion limit; or (b) the intermediate extension limit nearest to the comfort zone limit corresponds to an intermediate angle between the upper leg support and the lower leg support that is 1° greater than the comfort zone angle, if the comfort zone limit is set as an extension limit.

6. The device of claim 5 wherein more than one intermediate limit is set, and wherein:

(a) each intermediate flexion limit after the first in the sequence corresponds to an intermediate angle between the upper leg support and the lower leg support that is 1° less than the flexion angle which corresponds to the previous intermediate flexion limit in the sequence, if the comfort zone limit is set as a flexion limit; or (b) each intermediate extension limit after the first in the sequence corresponds to an intermediate angle between the upper leg support and the lower leg support that is 1° greater than the extension angle which corresponds to the previous intermediate extension limit in the sequence, if the comfort zone limit is set as an extension limit.

7. The device of claim 1 which includes a comfort zone actuator by which the patient sets the comfort zone limit as a flexion limit during a flexion phase or as an extension limit during an extension phase.

8. The device of claim 7 which includes means for setting a comfort zone limit upon actuation of the comfort zone actuator, which limit corresponds to a comfort zone angle between the upper leg support and the lower leg support that is:

(a) 5° greater than the flexion angle between the upper leg support and the lower leg support, upon actuation of the comfort zone actuator, if the comfort zone angle is set as a flexion limit during a flexion phase; or (b) 5° less than the extension angle between the upper leg support and the lower leg support, upon actuation of the comfort zone actuator, if the comfort zone angle is set as an extension limit during an extension phase.

9. The device of claim 7 wherein more than one intermediate limit is set, and wherein:

(a) the intermediate flexion limit nearest to the comfort zone limit corresponds to an intermediate angle between the upper leg support and the lower leg support that is 1° less than the comfort zone flexion angle, and each intermediate flexion limit after the first in the sequence corresponds to an intermediate angle between the upper leg support and the lower leg support that is 1° less than the flexion angle which corresponds to the previous intermediate flexion limit in the sequence, and the last intermediate flexion limit in the sequence corresponds to an intermediate angle between the upper leg support and the lower leg support that is equal to the flexion angle between the upper leg support and the lower leg support upon actuation of the comfort zone actuator, if the comfort zone limit is set as a flexion limit; or (b) the intermediate extension limit nearest to the comfort zone limit corresponds to an intermediate angle between the upper leg support and the lower leg support that is 1° greater than the comfort zone angle, and each intermediate extension limit after the first in the sequence corresponds to an intermediate angle between the upper leg support and the lower leg support that is 1° greater than the extension angle which corresponds to the previous intermediate extension limit in the sequence, and the last intermediate extension limit in the sequence corresponds to an intermediate angle between the upper leg support and the lower leg support that is equal to the extension angle between the upper leg support and the lower leg support upon actuation of the comfort zone actuator, if the comfort zone limit is set as an extension limit.

10. The device of claim 1 which includes:

(a) means for counting:

(1) the number of times the upper leg support and the lower leg support are pivoted from the operational extension limit to each intermediate flexion limit, if the comfort zone limit is set as a flexion limit;

(2) the number of times the upper leg support and the lower leg support are pivoted from the operational flexion limit to each intermediate extension limit, if the comfort zone limit is set as an extension limit;

(b) means for setting:

(1) the number of times the upper leg support and the lower leg support are pivoted from the operational extension limit to each intermediate flexion limit, if the comfort zone limit is set as a flexion limit;

(2) the number of times the upper leg support and the lower leg support are pivoted from the operational flexion limit to each intermediate extension limit, if the comfort zone limit is set as an extension limit.

11. The device of claim 10 wherein a plurality of intermediate limits are set, and wherein:

(a) after the set number of times the upper leg support and the lower leg support are pivoted from the operational extension limit to an intermediate flexion limit, if the comfort zone limit is set as a flexion limit, the flexion limit is moved to the next successive intermediate flexion limit;

(b) after the set number of times the upper leg support and the lower leg support are pivoted from the operational flexion limit to an intermediate extension limit, if the comfort zone limit is set as an extension limit, the extension limit is moved to the next successive intermediate extension limit.

12. The device of claim 11 wherein:

(a) the number of times the upper leg support and the lower leg support are pivoted from the operational extension limit to each intermediate flexion limit, if the comfort zone limit is set as a flexion limit, before the flexion limit is moved to the next successive intermediate flexion limit, may be set independently of the number of times the upper leg support and the lower leg support are pivoted from the operational extension limit to each other intermediate flexion limit;

(b) the number of times the upper leg support and the lower leg support are pivoted from the operational flexion limit to each intermediate extension limit, if the comfort zone limit is set as an extension limit, before the extension limit is moved to the next successive intermediate extension limit, may be set independently of the number of times the upper leg support and the lower leg support are pivoted from the operational flexion limit to each other intermediate extension limit.

13. The device of claim 1:

(a) wherein the upper leg support includes:

(1) an upper portion; and (2) a third support having a first end and a second end, the first end being pivotally attached to the frame and the second end being pivotally attached to the lower leg support; and (3) a linkage having a first end and a second end, the first end being pivotally attached to the upper portion and the second end being pivotally attached to the third support;

(b) wherein the means for repeatedly pivoting the lower leg support and the upper leg support at the connection therebetween includes:

(1) a motor;

(2) a driver that is adapted to move in both directions along the axis of the frame; and (3) a drive means that is adapted to interconnect the motor and the driver so that the driver may be moved along the axis of the frame by operation of the motor;

(c) wherein the second end of the lower leg support is attached to the driver;

(d) which includes:

(1) a foot support which is mounted to the lower leg support at its second end;

(2) means for setting a desired range of motion including an operational extension limit which corresponds to a point along the axis of the frame to which the driver may be moved during the extension phase by operation of the motor to establish an operational extension angle between the upper leg support and the lower leg support, and an operational flexion limit which corresponds to a point along the axis of the frame to which the driver may be moved by operation of the motor during the flexion phase to establish an operational flexion angle between the upper leg support and the lower leg support;

(3) means for setting a comfort zone limit, which limit corresponds to a point along the axis of the frame to which the driver may be moved by operation of the motor to set a comfort zone angle between the upper leg support and the lower leg support, wherein said comfort zone limit may be set:

(A) as a flexion limit corresponding to a point along the axis of the frame which establishes a comfort zone flexion angle that is greater than the operational flexion angle; or (B) as an extension limit corresponding to a point along the axis of the frame which establishes a comfort zone extension angle that is less than the operational extension angle;

(4) means for setting at least one intermediate limit corresponding to a point along the axis of the frame to which the driver may be moved by operation of the motor to establish an intermediate angle between the upper leg support and the lower leg support, wherein each such intermediate limit may be set:

(A) as a flexion limit, if the comfort limit is set as a flexion limit, so that each intermediate flexion limit will correspond to a point along the axis of the frame which establishes a flexion angle that is less than the comfort zone flexion angle and greater than the operational flexion angle, and so that if more than one intermediate flexion limit is set, each such limit after the first in a sequence of such limits will correspond to a flexion angle that is less than the flexion angle which corresponds to the previous flexion limit in the sequence; or (B) as an intermediate limit, if the comfort limit is set as an extension limit, so that each intermediate extension limit will correspond to a point along the axis of the frame which establishes an extension angle that is greater than the comfort zone extension angle and less than the operational extension angle, and so that if more than one intermediate extension limit is set, each such limit after the first in a sequence of such limits will correspond to an extension angle that is greater than the extension angle which corresponds to the previous extension limit in the sequence;

(5) means for activating the motor to drive the driver along the axis of the frame;

(6) means for reversing the direction of movement of the driver along the axis of the frame during a flexion phase when the driver reaches a flexion limit;

(7) means for reversing the direction of movement of the driver along the axis of the frame during an extension phase when the driver reaches an extension limit;

wherein the upper leg support, the lower leg support, the third support and the linkage are arranged and interconnected so that the upper leg support may pivot about a virtual pivot axis which is proximate to the patient's hip joint; and wherein because of the interconnection of said supports and the linkage, and the connection of the lower leg support to the driver, movement of the driver in one direction along the axis will cause extension and movement of the driver in the opposite direction along the axis will cause flexion.

14. The device of claim 13 which includes:

(a) means for counting:

(1) the number of times the driver moves between the operational flexion limit and each intermediate extension limit, if the comfort zone limit is set as an extension limit;

(2) the number of times the driver moves between the operational extension limit and each intermediate flexion limit, if the comfort zone limit is set as a flexion limit;

(b) means for setting:

(1) the number of times the driver moves between the operational flexion limit and each intermediate extension limit, if the comfort zone limit is set as an extension limit;

(2) the number of times the driver moves between the operational extension limit and each intermediate flexion limit, if the comfort zone limit is set as a flexion limit.

15. The device of claim 13 wherein the length of the third support is adjustable.

16. The device of claim 13 wherein the foot support is pivotally mounted at the second end of the lower leg support.

17. The device of claim 13 which includes a storage means capable of storing data about one or more different patients including the extension and flexion limits used during a treatment session for each of the patients.

18. The device of claim 13 wherein:

(a) the drive means includes an externally threaded drive rod which is mounted in the frame and disposed along the axis of the frame, which drive rod is adapted to be turned by the motor; and (b) the driver includes an internally threaded nut that is adapted to mate with the drive rod, which nut is mounted on the drive rod in threaded engagement therewith, so that the driver may be moved along the axis of the frame as the drive rod is turned the motor.

19. The device of claim 13 which includes:

(a) means for decelerating the driver at a predetermined rate as it approaches an extension limit beginning at a predetermined distance along the axis from the extension limit;

(b) means for accelerating the driver at a predetermined rate for a predetermined distance after it reverses direction upon reaching an extension limit;

(c) means for decelerating the driver at a predetermined rate as it approaches a flexion limit beginning at a predetermined distance along the axis from the flexion limit;

(d) means for accelerating the driver at a predetermined rate for a predetermined distance after it reverses direction upon reaching a flexion limit.

20. The device of claim 21 wherein:

(a) the predetermined distance along the axis at which deceleration of the driver as it approaches an extension limit begins defines a point along the axis of the frame that establishes an angle between the upper leg support and the lower leg support that is approximately 1–2° less than the angle of the extension limit for such cycle;

(b) the predetermined distance along the axis during which the driver is accelerated after it reverses direction upon reaching an extension limit defines a point along the axis of the frame that establishes an angle between the upper leg support and the lower leg support that is approximately 1–2° less than the angle of the extension limit for such cycle;

(c) the predetermined distance along the axis at which deceleration of the driver as it approaches a flexion limit begins defines a point along the axis of the frame that establishes an angle between the upper leg support and the lower leg support that is approximately 1–2° greater than the angle of the flexion limit for such cycle;

(d) the predetermined distance along the axis during which the driver is accelerated after it reverses direction upon reaching a flexion limit defines a point along the axis of the frame that establishes an angle between the upper leg support and the lower leg support that is approximately 1–2° greater than the angle of the flexion limit for such cycle.

21. A method for providing physical therapy for a patient's knee by moving the patient's leg through a plurality of cycles of motion in which the patient's upper leg is pivoted with respect to the patients lower leg at the knee, wherein each cycle imposes a range of motion on the patient's leg comprising a flexion phase in which the angle between the femur of the patient's upper leg and the tibia of the patient's lower leg is decreasing and an extension phase in which the angle between the femur of the patient's upper leg and the tibia of the patient's lower leg is increasing, and wherein each cycle of motion is defined by a flexion limit which establishes the minimum angle between the femur of the patient's upper leg and the tibia of the patient's lower leg to which the patient's leg is pivoted during a flexion phase and an extension limit which establishes the maximum angle between the femur of the patient's upper leg and the tibia of the patient's lower leg to which the patient's leg is pivoted during an extension phase, which method comprises:

(a) providing a therapeutic device that is adapted to receive the upper leg and the lower leg of a patient, said device comprising:

(1) an elongated frame having an axis;

(2) a motor;

(3) a driver that is adapted to move in both directions along the axis of the frame;

(4) a drive means that is adapted to interconnect the motor and the driver so that operation of the motor will move the driver along the axis of the frame;

(5) a lower leg support having a first end and a second end and being adapted to support the lower leg of the patient, wherein the second end of the lower leg support is attached to the driver;

(6) an upper leg support having a first end and a second end and being adapted to support the upper leg of the patient, wherein the first end of the upper leg support is pivotally connected to the first end of the lower leg support, and wherein the upper leg support includes:

(A) an upper portion; and (B) a third support having a first end and a second end, the first end being pivotally attached to the frame and the second end being pivotally attached to the lower leg support; and (C) a linkage having a first end and a second end, the first end being pivotally attached to the upper portion and the second end being pivotally attached to the third support;

wherein the upper leg support, the lower leg support, the third support and the linkage are arranged and interconnected so that the upper leg support pivots about a virtual pivot axis which is proximate to the patient's hip joint; and wherein because of the interconnection of said supports and the linkage, and the connection of the lower leg support to the driver, movement of the driver in one direction along the axis comprises an extension phase and movement of the driver in the opposite direction along the axis comprises a flexion phase, so that movement of the driver along the axis of the frame will cause said upper leg support and said lower leg support to be pivoted with respect to each other through a plurality of pivotal positions, each of which establishes an angle between said upper leg support and said lower leg support corresponding to an angle between the femur of the patient's upper leg and the tibia of the patient's lower leg;

(7) a foot support which is mounted to the lower leg support at its second end;

(8) means for setting a desired range of motion including an operational extension limit which corresponds to a point along the axis of the frame to which the driver is moved during the extension phase of a cycle by operation of the motor to establish an operational extension angle between the upper leg support and the lower leg support, and an operational flexion limit which corresponds to a point along the axis of the frame to which the driver is moved by operation of the motor during the flexion phase of a cycle to establish a flexion angle between the upper leg support and the lower leg support;

(9) means for setting a comfort zone flexion limit within the desired range of motion, which comfort zone limit corresponds to a point along the axis of the frame to which the driver is moved by operation of the motor to establish a comfort zone flexion angle between the upper leg support and the lower leg support that is greater than the operational flexion angle;

(10) means for setting at least one intermediate flexion limit within the desired range of motion, wherein each such intermediate limit corresponds to a point along the axis of the frame to which the driver is moved by operation of the motor to establish an intermediate flexion angle between the upper leg support and the lower leg support that is less than the comfort zone flexion angle and greater than the operational flexion angle, and so that if more than one intermediate flexion limit is set, each such limit after the first in a sequence of such limits will correspond to a flexion angle that is less than the flexion angle which corresponds to the previous flexion limit in the sequence;

(11) means for activating the motor to drive the driver along the axis of the frame;

(12) means for reversing the direction of movement of the driver along the axis of the frame during a flexion phase when the driver reaches a flexion limit;

(13) means for reversing the direction of movement of the driver along the axis of the frame during an extension phase when the driver reaches an extension limit;

(14) means for counting the number of times that the driver is moved from the operational extension limit to the comfort zone limit;

(15) means for setting the number of times that the driver is moved from the operational extension limit to the comfort zone limit;

(16) means for moving the flexion limit sequentially from the operational flexion limit to the comfort zone limit, and then to each intermediate flexion limit, in turn, wherein each successive intermediate flexion limit is nearer to the operational flexion limit than the next preceding intermediate flexion limit, and then to the operational flexion limit;

(b) setting an operational flexion limit;

(c) setting an operational extension limit;

(d) activating the motor so that the driver is moved back and forth along the axis of the frame between the operational flexion limit and the operational extension limit by operation of the motor;

(e) setting a comfort zone flexion limit;

(f) setting an intermediate flexion limit;

(g) setting a number of times that the driver is moved from the operational extension limit to the comfort zone flexion limit and back to the operational extension limit;

(h) moving the flexion limit from the operational flexion limit to the comfort zone flexion limit;

(i) moving the driver from the operational extension limit to the comfort zone flexion limit and back to the operational extension limit the set number of times;

(j) moving the flexion limit to the intermediate flexion limit nearest to the comfort zone limit;

(k) moving the driver from the operational extension limit to the intermediate flexion limit nearest to the comfort zone limit and back to the operational extension limit;

(l) moving the flexion limit to the operational flexion limit;

(m) moving the driver from the operational extension limit to the operational flexion limit.

22. The method of claim 23 which includes setting a plurality of sequential intermediate flexion limits, each of which corresponds to a point along the axis of the frame which will establish a flexion angle that is about 1° less than the flexion angle established at the next preceding intermediate flexion limit.

23. The method of claim 23 which includes:

(a) providing a therapeutic device that includes:

(1) a comfort zone actuator by which the patient sets the comfort zone limit as a flexion limit during a flexion phase or as an extension limit during an extension phase;

(2) means for setting a comfort zone limit that corresponds to a comfort zone angle between the upper leg support and the lower leg support that is:

(A) 5° greater than the flexion angle between the upper leg support and the lower leg support if the comfort zone angle is set as a flexion limit during a flexion phase; or (B) 5° less than the extension angle between the upper leg support and the lower leg support if the comfort zone angle is set as an extension limit during an extension phase;

(b) setting a comfort zone limit that corresponds to a comfort zone angle between the upper leg support and the lower leg support that is:

(1) 5° greater than the flexion angle between the upper leg support and the lower leg support if the comfort zone angle is set as a flexion limit during a flexion phase; or (2) 5° less than the extension angle between the upper leg support and the lower leg support if the comfort zone angle is set as an extension limit during an extension phase.

24. The method of claim 25 which includes reversing the direction of the driver upon actuation of the comfort zone actuator.

* * * * *

UNITED STATES PATENT AND TRADEMARK OFFICE

CERTIFICATE OF CORRECTION

PATENT NO. : 6,267,735 B1
DATED : July 31, 2001
INVENTOR(S) : Frederick W. Blanchard, Stephen L. Brown, Dwayne Hofstatter, D. Chris Linville, Jeffrey K. Pohl, James R. Vetter It is certified that error appears in the above-identified patent and that said Letters Patent is hereby corrected as shown below:

Column 27, claim 18, part (b),
Line 62, add the word -- by -- after the word "turned".

Column 28, claim 21,
Line 41, delete the word "patients" and substitute therefor the word -- patient's --.

Signed and Sealed this

Nineteenth Day of March, 2002

*Attest:*

*Attesting Officer*

JAMES E. ROGAN
*Director of the United States Patent and Trademark Office*